US011391302B2

(12) United States Patent
Sutkowski et al.

(10) Patent No.: US 11,391,302 B2
(45) Date of Patent: Jul. 19, 2022

(54) AUTOMATIC AIR BLEEDING SYSTEM FOR HYDRAULICS

(71) Applicant: Woodward, Inc., Fort Collins, CO (US)

(72) Inventors: Krzysztof Sutkowski, Cracow (PL); Marek Kazimierz Redzina, Cracow (PL)

(73) Assignee: Woodward, Inc., Fort Collins, CO (US)

( * ) Notice: Subject to any disclaimer, the term of this patent is extended or adjusted under 35 U.S.C. 154(b) by 0 days.

(21) Appl. No.: 17/202,090

(22) Filed: Mar. 15, 2021

(65) Prior Publication Data

US 2021/0285470 A1 Sep. 16, 2021

Related U.S. Application Data

(60) Provisional application No. 62/990,037, filed on Mar. 16, 2020.

(51) Int. Cl.
*F15B 9/09* (2006.01)
*F15B 13/043* (2006.01)
(Continued)

(52) U.S. Cl.
CPC ..... *F15B 13/0435* (2013.01); *F15B 9/03* (2013.01); *F15B 13/16* (2013.01); *F15B 19/005* (2013.01);
(Continued)

(58) Field of Classification Search
CPC ..... F15B 13/0435; F15B 13/16; F15B 13/0402; F15B 13/0442; F15B 9/03; F15B 19/005;
(Continued)

(56) References Cited

U.S. PATENT DOCUMENTS 5,313,873 A * 5/1994 Gall ..... F15B 1/02 91/452
5,615,593 A * 4/1997 Anderson ..... F15B 21/087 91/363 R
(Continued)

FOREIGN PATENT DOCUMENTS

| | | |
|---|---|---|
| DE | 3225003 | 1/1984 |
| DE | 3525003 | 1/1984 |
| DE | 10103229 | 8/2002 |

OTHER PUBLICATIONS

PCT International Search Report and Written Opinion in International Appln. No. PCT/US2021/022558, dated Jun. 15, 2021, 13 pages.

*Primary Examiner* — Minh Q Le
(74) *Attorney, Agent, or Firm* — Fish & Richardson P.C.

(57) ABSTRACT

The subject matter of this specification can be embodied in, among other things, a method that includes actuating a closure member at a predetermined first velocity a predetermined first number of cycles between a first configuration and a second configuration, actuating the closure member at a predetermined second velocity a predetermined second number of cycles between the first and the second configuration, actuating the closure member at a predetermined third velocity a predetermined third number of cycles and the second configuration, actuating the closure member at a predetermined fourth velocity a predetermined fourth number of cycles and the second configuration, and actuating the closure member to the second configuration at a predetermined fifth velocity for a predetermined flushing period.

22 Claims, 15 Drawing Sheets

(51) Int. Cl.

| | |
|---|---|
| ***F15B 9/03*** | (2006.01) |
| ***F15B 13/16*** | (2006.01) |
| ***F15B 19/00*** | (2006.01) |
| ***F15B 21/044*** | (2019.01) |
| *F15B 13/044* | (2006.01) |
| *F15B 13/04* | (2006.01) |
| *F15B 21/08* | (2006.01) |

(52) U.S. Cl.
CPC ..... *F15B 21/044* (2013.01); *F15B 13/0402* (2013.01); *F15B 13/0442* (2013.01); *F15B 21/087* (2013.01); *F15B 2013/0413* (2013.01); *F15B 2211/3122* (2013.01); *F15B 2211/328* (2013.01); *F15B 2211/85* (2013.01); *F15B 2211/864* (2013.01); *F15B 2211/865* (2013.01); *F15B 2211/8626* (2013.01); *F15B 2211/8636* (2013.01)

(58) Field of Classification Search
CPC ..... F15B 21/044; F15B 21/087; F15B 2013/0413; F15B 2211/3122; F15B 2211/328; F15B 2211/85; F15B 2211/8626; F15B 2211/8636; F15B 2211/864; F15B 2211/865
USPC ..... 137/551, 487.5; 91/466, 454, 469, 509, 91/420, 421
See application file for complete search history.

(56) References Cited

U.S. PATENT DOCUMENTS

| | | | | |
|---|---|---|---|---|
| 8,056,465 | B2 * | 11/2011 | Carlz | A01C 7/205 91/420 |
| 8,549,983 | B2 * | 10/2013 | Brahmer | B30B 15/16 91/443 |
| 2013/0186472 | A1 * | 7/2013 | Schottler | E02F 9/2267 137/12 |
| 2014/0174543 | A1 * | 6/2014 | Rannow | F15B 20/00 137/1 |
| 2018/0128290 | A1 * | 5/2018 | Wang | F15B 21/02 |
| 2018/0156244 | A1 * | 6/2018 | Ma | F15B 13/021 |
| 2019/0010965 | A1 * | 1/2019 | Green | F04B 49/08 |
| 2019/0186511 | A1 * | 6/2019 | Rannow | F15B 20/005 |
| 2019/0383310 | A1 | 12/2019 | Ortner et al. | |
| 2020/0240444 | A1 * | 7/2020 | Tadje | F15B 13/0435 |
| 2021/0270293 | A1 * | 9/2021 | Broekx | B66F 9/22 |
| 2021/0285466 | A1 * | 9/2021 | Workman | F15B 13/0442 |

* cited by examiner

700a

700b

AUTOMATIC AIR BLEEDING SYSTEM FOR HYDRAULICS

CROSS-REFERENCE TO RELATED APPLICATIONS

This application claims the benefit of priority to U.S. Patent Application No. 62/990,037, filed Mar. 16, 2020, the contents of which are incorporated by reference herein.

TECHNICAL FIELD

This instant specification relates to servo valve based control of hydraulic actuators.

BACKGROUND

Hydraulic actuators are used to actuate mechanical outputs such as valves and articulated motion control outputs. In order to achieve various safety, reliability, and performance requirements, various forms of redundancy are utilized.

Some existing systems provide redundancy by including doubled coils on servo valves that control the flow of fluid to hydraulic actuators through shared hydraulic paths. Some other existing systems provide redundant pressure control.

SUMMARY

In general, this document describes systems and techniques for servo valve based control of hydraulic actuators.

In a general aspect, a method of operating a hydraulic actuator system includes actuating a closure member of a valve assembly at a predetermined first velocity a predetermined first number of cycles between a first configuration in which a fluid flow path is flushed for a predetermined first drain period and a second configuration in which fluid flow is flushed for a predetermined first flushing period, actuating the closure member at a predetermined second velocity a predetermined second number of cycles between the first configuration for a predetermined second drain period and the second configuration for a predetermined second flushing period, actuating the closure member at a predetermined third velocity a predetermined third number of cycles between the first configuration for a predetermined third drain period and the second configuration for a predetermined third flushing period, actuating the closure member at a predetermined fourth velocity a predetermined fourth number of cycles between the first configuration for a predetermined fourth drain period and the second configuration for a predetermined fourth flushing period, and actuating the closure member at a predetermined fifth velocity a predetermined fifth number of cycles between the first configuration for a predetermined fifth drain period and the second configuration for a predetermined fifth flushing period.

Various implementations can include some, all, or none of the following features. The closure member can be configured to flush air residuals trapped in the valve assembly with hydraulic fluid provided to the valve assembly while in the second configuration. The second drain period can be longer than the first drain period and the third drain period, the fourth drain period can be longer than the second drain period, and the fifth flushing period is longer than fourth flushing period. The second flushing period can be longer than the first flushing period and the third flushing period, and the fourth flushing period can be longer than the second flushing period. The fifth velocity can be less than the first velocity, the second velocity, the third velocity, and the fourth velocity. One or more of the first number of cycles, the second number of cycles, the third number of cycles, the fourth number of cycles, the first drain period, the second drain period, the third drain period, the fourth drain period, the fifth drain period, the first flushing period, the second flushing period, the third flushing period, the fourth flushing period, and the fifth flushing period can be based on a pressure of hydraulic fluid provided to the valve assembly. The first drain period can be less than 2 seconds, the second drain period can be less than 5 seconds, the third drain period can be less than 2 seconds, the fourth drain period can be less than 30 seconds, the fifth drain period is less than 30 seconds, the first flushing period can be less than 1 second, the second flushing period can be less than 5 seconds, the third flushing period can be less than 1 second, the fourth flushing period can be less than 30 seconds, and the fifth flushing period can be between 10 seconds and 360 seconds. The method can also include providing a hydraulic fluid at a pressure less than or equal to 289 psig, wherein the first number of cycles can be between 300 and 700, the second number of cycles can be between 100 and 500, the third number of cycles can be between 100 and 450, the fourth number of cycles can be between 10 and 30, and the fifth number of cycles is between 1 and 10. The method can also include providing a hydraulic fluid at a pressure greater than 289 psig, wherein the first number of cycles can be between 100 and 500, the second number of cycles can be between 50 and 300, the third number of cycles can be between 50 and 300, the fourth number of cycles can be between 5 and 20, and the fifth number of cycles is between 1 and 10. The first velocity can be between 500%/sec and 1000%/sec of a travel of the closure member, the second velocity can be between 500%/sec and 1000%/sec of the closure member's travel, the third velocity can be between 500%/sec and 1000%/sec of the closure member's travel, the fourth velocity can be between 500%/sec and 1000%/sec of the closure member's travel, and the fifth velocity can be between 10%/sec and 50%/sec of the closure member's travel. The valve assembly can include a fluid supply port, a fluid drain port, and a fluid control port, and the closure member is configurable into a plurality of valve configurations including the first configuration in which the fluid control port is in fluid communication with the fluid drain port, and the fluid supply port is blocked, the second configuration in which the fluid control port is in fluid communication with the fluid supply port and is in fluid communication with the fluid drain port through a fluid restrictor, and the fluid flow comprises flow from the fluid control port to the fluid drain port through the fluid restrictor, a third configuration in which fluid communication between the fluid control port, the fluid supply port, and the fluid drain port is blocked, and a fourth configuration in which the fluid control port is in fluid communication with the fluid supply port, and the fluid drain port is blocked.

In another general aspect, a hydraulic actuator system includes a valve assembly having a fluid supply port in fluid communication with the main fluid supply conduit, a fluid drain port, and a fluid control port in fluid communication with the main fluid control conduit, and a controller configured to control operation of the valve assembly, the operations including actuating a closure member of the valve assembly at a predetermined first velocity a predetermined first number of cycles between a first configuration in which fluid flow is drained for a predetermined first drain period and a second configuration in which a fluid flow path is flushed for a predetermined first flushing period, actuating the closure member at a predetermined second velocity a predetermined second number of cycles between the first configuration for a predetermined second drain period and the second configuration for a predetermined second flushing period, actuating the closure member at a predetermined third velocity a predetermined third number of cycles between the first configuration for a predetermined third drain period and the second configuration for a predetermined third flushing period, actuating the closure member at a predetermined fourth velocity a predetermined fourth number of cycles between the first configuration for a predetermined fourth drain period and the second configuration for a predetermined fourth flushing period, and actuating the closure member to at a predetermined fifth velocity a predetermined fifth number of cycles between the first configuration for a predetermined fifth drain period and the second configuration for a predetermined fifth flushing period.

Various embodiments can include some, all, or none of the following features. Actuation of the closure member can mix and flush air residuals trapped in the valve assembly with hydraulic fluid provided to the valve assembly. The second drain period can be longer than the first drain period and the third drain period, and the fourth drain period can be longer than the second drain period. The second flushing period can be longer than the first flushing period and the third flushing period, the fourth flushing period can be longer than the second flushing period, and the fifth flushing period is longer than the fourth flushing period. The fifth velocity can be less than the first velocity, the second velocity, the third velocity, and the fourth velocity. One or more of the first number of cycles, the second number of cycles, the third number of cycles, the fourth number of cycles, the first drain period, the second drain period, the third drain period, the fourth drain period, the fifth drain period, the first flushing period, the second flushing period, the third flushing period, the fourth flushing period, and the fifth flushing period can be based on a pressure of hydraulic fluid provided to the valve assembly. The first drain period can be less than 2 seconds, the second drain period can be less than 5 seconds, the third drain period can be less than 2 seconds, the fourth drain period can be less than 30 seconds, the fifth drain period can be less than 30 seconds, the first flushing period can be less than 1 second, the second flushing period can be less than 5 seconds, the third flushing period can be less than 1 second, the fourth flushing period can be less than 30 seconds, and the fifth flushing period can be between 10 seconds and 360 seconds. The operations can also include providing a hydraulic fluid at a pressure less than or equal to 289 psig, wherein the first number of cycles can be between 300 and 700, the second number of cycles can be between 100 and 500, the third number of cycles can be between 100 and 450, the fourth number of cycles can be between 10 and 30, and the fifth number of cycles is between 1 and 10. The operations can also include providing a hydraulic fluid at a pressure greater than 289 psig, wherein the first number of cycles can be between 100 and 500, the second number of cycles can be between 50 and 300, the third number of cycles can be between 50 and 300, the fourth number of cycles can be between 5 and 20, and the fifth number of cycles is between 1 and 10. The first velocity can be between 500%/sec and 1000%/sec of a travel of the closure member, the second velocity can be between 500%/sec and 1000%/sec of the closure member's travel, the third velocity can be between 500%/sec and 1000%/sec of the closure member's travel, the fourth velocity can be between 500%/sec and 1000%/sec of the closure member's travel, and the fifth velocity can be between 10%/sec and 50%/sec of the closure member's travel. The valve assembly can include a fluid supply port, a fluid drain port, and a fluid control port, and the closure member is configurable into a plurality of valve configurations including the first configuration in which the fluid control port is in fluid communication with the fluid drain port, and the fluid supply port is blocked, the second configuration in which the fluid control port is in fluid communication with the fluid supply port and is in fluid communication with the fluid drain port through a fluid restrictor, and the fluid flow comprises flow from the fluid control port to the fluid drain port through the fluid restrictor, a third configuration in which fluid communication between the fluid control port, the fluid supply port, and the fluid drain port is blocked, and a fourth configuration in which the fluid control port is in fluid communication with the fluid supply port, and the fluid drain port is blocked.

In another general aspect, an electrohydraulic positioning control system includes a shuttle valve configured to direct fluid flow between a selectable one of a first fluid port and a second fluid port, and a fluid outlet configured to be fluidically connected to a fluid actuator, a first servo valve controllable to selectably permit flow between the first fluid port and a fluid source, permit flow between the first fluid port and a fluid drain, and block fluid flow between the first fluid port, the fluid source, and the fluid drain, a second servo valve controllable to selectably permit flow between the second fluid port and the fluid source, permit flow between the second fluid port and the fluid drain, and block fluid flow between the second fluid port, the fluid source, and the fluid drain, a first servo controller configured to provide a first health signal and control the first servo valve based on a position demand signal, a position feedback signal, a first priority signal, and a second health signal, and a second servo controller configured to provide the second health signal and control the second servo valve based on the position demand signal, the position feedback signal, a second priority signal, and the first health signal.

Various embodiments can include some, all, or none of the following features. At least one of the first priority signal and the second priority signal can include representations of one or more operational conditions including (a) a high priority command provided to a selected one of the first servo controller or the second servo controller to act as a primary servo controller, and (b) a low priority command provided to the other of the first servo controller or the second servo controller to act as a reserve servo controller. The first servo controller can be configured to perform operations that include receiving, by the first servo controller, the high priority command as the first priority signal, controlling, by the first servo controller, the first servo valve to control a position of the fluid actuator by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. At least one of the first health signal and the second health signal can be configurable to comprise representations of one or more operational conditions including (a) an operable condition indicating an absence of failure, (b) a fail condition indicative of a failure that is addressable a shutdown of a corresponding one of the first servo valve or the second servo valve, and (c) a failure of the health signal that represents an inability to transmit any of above conditions. The first servo controller can be configured to perform operations that include receiving, by the first servo controller, the low priority command as the first priority signal, detecting, by the first servo controller, the fail condition in the second servo controller or the second servo valve, controlling, by the first servo controller, the first servo valve to control a position of the fluid actuator by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. The first servo controller can be configured to perform operations including receiving, by the first servo controller, the low priority command as the first priority signal, detecting, by the first servo controller, the operable condition in the second servo controller and the second servo valve, and controlling, by the first servo controller, the first servo valve to provide a fluidic connection from the first fluid port to the fluid drain and to block the fluid source. The first servo controller can be configured to perform operations including receiving, by the first servo controller, the low priority command as the first priority signal, detecting, by the first servo controller, failure of the second health signal, determining, by the first servo controller and based on the detecting, a modified position demand that is less than a position demand represented by the position demand signal, controlling, by the first servo controller, the first servo valve to control a position of the fluid actuator based on the modified position demand by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. The first servo controller can be configured to perform operations including receiving, by the first servo controller, the low priority command as the first priority signal, controlling, by the first servo controller and based on the receiving, the first servo valve to a standby position based on a standby demand, detecting, by the first servo controller and based on the second health signal, the operable condition in the second servo controller and the second servo valve, receiving, by the first servo controller, a command signal representative of a silt reduction operation, controlling, by the first servo controller and in response to the received first priority signal, the first servo valve to a first modified position that is below standby position based on the standby demand, and controlling, by the first servo controller and in response to the received first priority signal, the first servo valve to the standby position based on a standby demand.

In another general aspect, a method for controlling an electrohydraulic positioning control system includes controlling, by a first servo controller configured to provide a first health signal, a first servo valve to selectably permit flow between a first fluid port and a fluid source, permit flow between the first fluid port and a fluid drain, and block fluid flow between the first fluid port, the fluid source, and the fluid drain, wherein the controlling is based on a position demand signal, a position feedback signal, a first priority signal, and a second health signal, providing, by the first servo controller, the first health signal, controlling, by a second servo controller, a second servo valve to selectably permit flow between a second fluid port and the fluid source, permit flow between the second fluid port and the fluid drain, and block fluid flow between the second fluid port, the fluid source, and the fluid drain, wherein the controlling is based on the position demand signal, the position feedback signal, a second priority signal, and the first health signal, providing, by the second servo controller, the second health signal, and directing, by a shuttle valve, fluid flow between a selectable one of the first fluid port and the second fluid port, and a fluid outlet configured to be fluidically connected to a fluid actuator.

Various implementations can include some, all, or none of the following features. At least one of the first priority signal and the second priority signal can include representations of one or more operational conditions including (a) a high priority command provided to a selected one of the first servo controller or the second servo controller to act as a primary servo controller, and (b) a low priority command provided to the other of the first servo controller or the second servo controller to act as a reserve servo controller. The method can also include receiving, by the first servo controller, the high priority command as the first priority signal, controlling, by the first servo controller, the first servo valve to control a position of the fluid actuator by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. At least one of the first health signal and the second health signal can be configurable to include representations of one or more operational conditions that include (a) an operable condition indicating an absence of failure, (b) a fail condition indicative of a failure that is addressable a shutdown of a corresponding one of the first servo valve or the second servo valve, and (c) a failure of the health signal that represents an inability to transmit any of above conditions. The method can include receiving, by the first servo controller, the low priority command as the first priority signal, detecting, by the first servo controller, the fail condition in the second servo controller or the second servo valve, controlling, by the first servo controller, the first servo valve to control a position of the fluid actuator by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. The method can also include receiving, by the first servo controller, the low priority command as the first priority signal, detecting, by the first servo controller, the operable condition in the second servo controller and the second servo valve, and controlling, by the first servo controller, the first servo valve to provide a fluidic connection from the first fluid port to the fluid drain and to block the fluid source. The method can also include receiving, by the first servo controller, the low priority command as the first priority signal, detecting, by the first servo controller, failure of the second health signal, determining, by the first servo controller and based on the detecting, a modified position demand that is less than a position demand represented by the position demand signal, controlling, by the first servo controller, the first servo valve to control a position of the fluid actuator based on the modified position demand by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. The method can also include receiving, by the first servo controller, the low priority command as the first priority signal, controlling, by the first servo controller and based on the receiving, the first servo valve to a standby position based on a standby demand, detecting, by the first servo controller and based on the second health signal, the operable condition in the second servo controller and the second servo valve, receiving, by the first servo controller, a command signal representative of a silt reduction operation, controlling, by the first servo controller and in response to the received command signal, the first servo valve to a first modified position that is below standby position, and controlling, by the first servo controller and in response to the received command signal, the first servo valve to the standby position.

The systems and techniques described here may provide one or more of the following advantages. First, the system can provide redundant control of a controlled process. Second, the system can improve system uptime. Third, the system can detect internal faults independently of a supervising controller. Fourth, the system can engage its redundant features independently of a supervising controller. Fifth, the system can bleed residual air without interrupting active control operations. Sixth, the system clear itself of contaminant buildup without interrupting active control operations.

The details of one or more implementations are set forth in the accompanying drawings and the description below. Other features and advantages will be apparent from the description and drawings, and from the claims.

DETAILED DESCRIPTION

This document describes systems and techniques for redundant hydraulic servo control. In general, system uptime and reliability are highly important factors in some processes that are controlled by hydraulic servo control systems. For example, some operations require a system to operate for 8-10 years without shutdown. In order to mitigate operational risks of critical components, the hydraulic control systems described in this document include features that provide redundancy (e.g., a primary hydraulic servo valve and controller, a backup hydraulic servo valve and controller that is kept online, and an automatic failover process for transferring control between the primary and the backup units) and online serviceability (e.g., one servo valve can be replaced and purged while the other maintains control) that can reduce or eliminate operational downtime.

Figure 1:
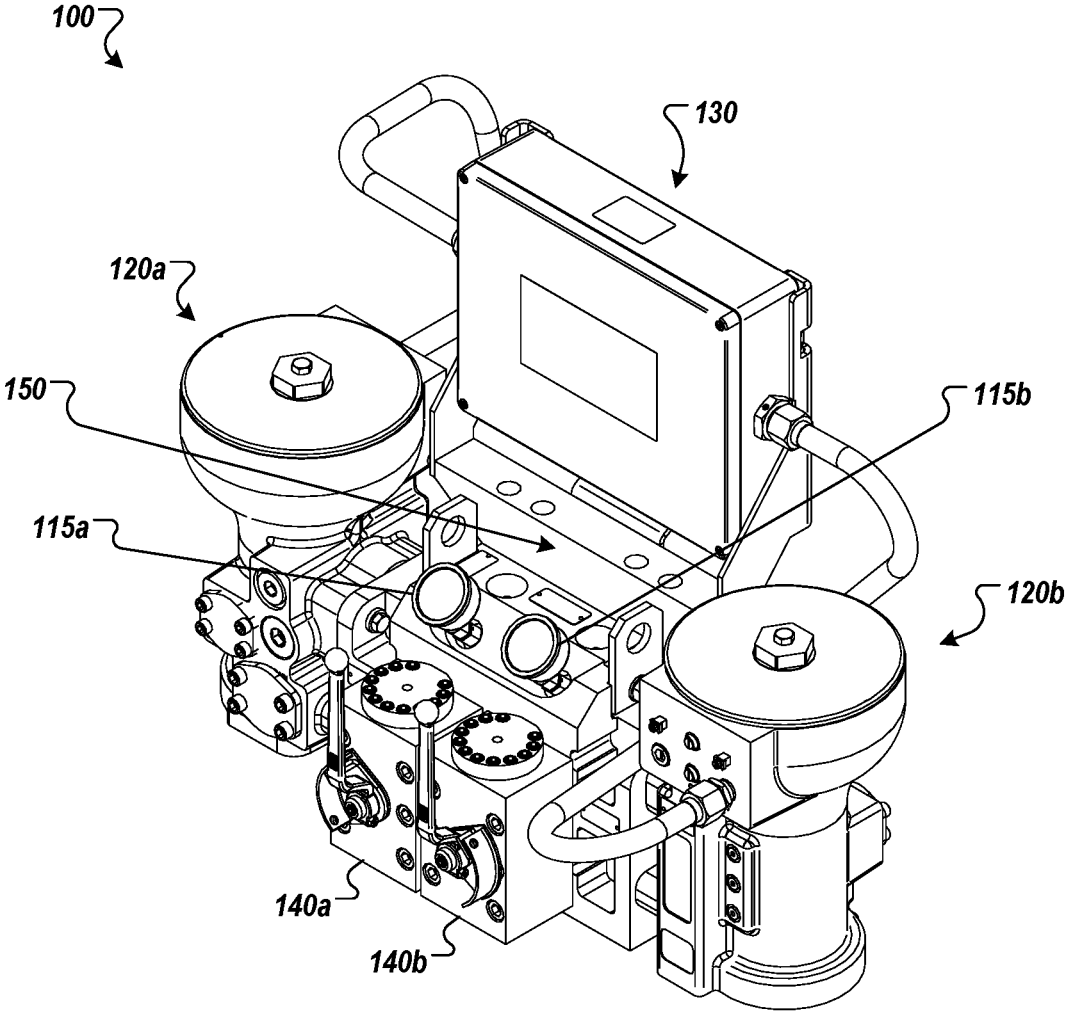
FIG. 1 is a perspective view of an example hydraulic control system.

FIG. 1 is a perspective view of an example hydraulic control system 100. The system 100 includes an electro hydraulic servo valve (EHSV) module 120*a* and an EHSV module 120*b* connected into a single manifold 150. An electrical junction box 130 houses power and control components for the system 100. Each of the EHSV modules 120*a*-120*b* includes a controller and electromechanical components that can control the flow of hydraulic fluid to the manifold 150. The manifold 150 includes isolation valves, needle valves, and a shuttle valve subassembly. A pressure gauge 115*a* is configured to show an output pressure of the EHSV module 120*a*, and a pressure gauge 115*b* is configured to show an output pressure of the EHSV module 120*b*. An isolation valve 140*a* provides an operator with a capability to fluidically isolate the EHSV module 120*a* from the rest of the system 100, and an isolation valve 140*b* provides an operator with a capability to fluidically isolate the EHSV module 120*b* from the rest of the system 100 (e.g., to permit service or replacement of one EHSV module while the other remains in service).

In the illustrated example, the system 100 provides two substantially identical, redundant hydraulic-position controllers (servos), two substantially independent sensors, and substantially independent flow paths. In use, the system generally uses the EHSV module 120*a* as a primary valve controller, and keeps the EHSV module 120*b* in reserve as a redundant backup (although in some implementations, the valve roles may be reversed).

Figure 2:
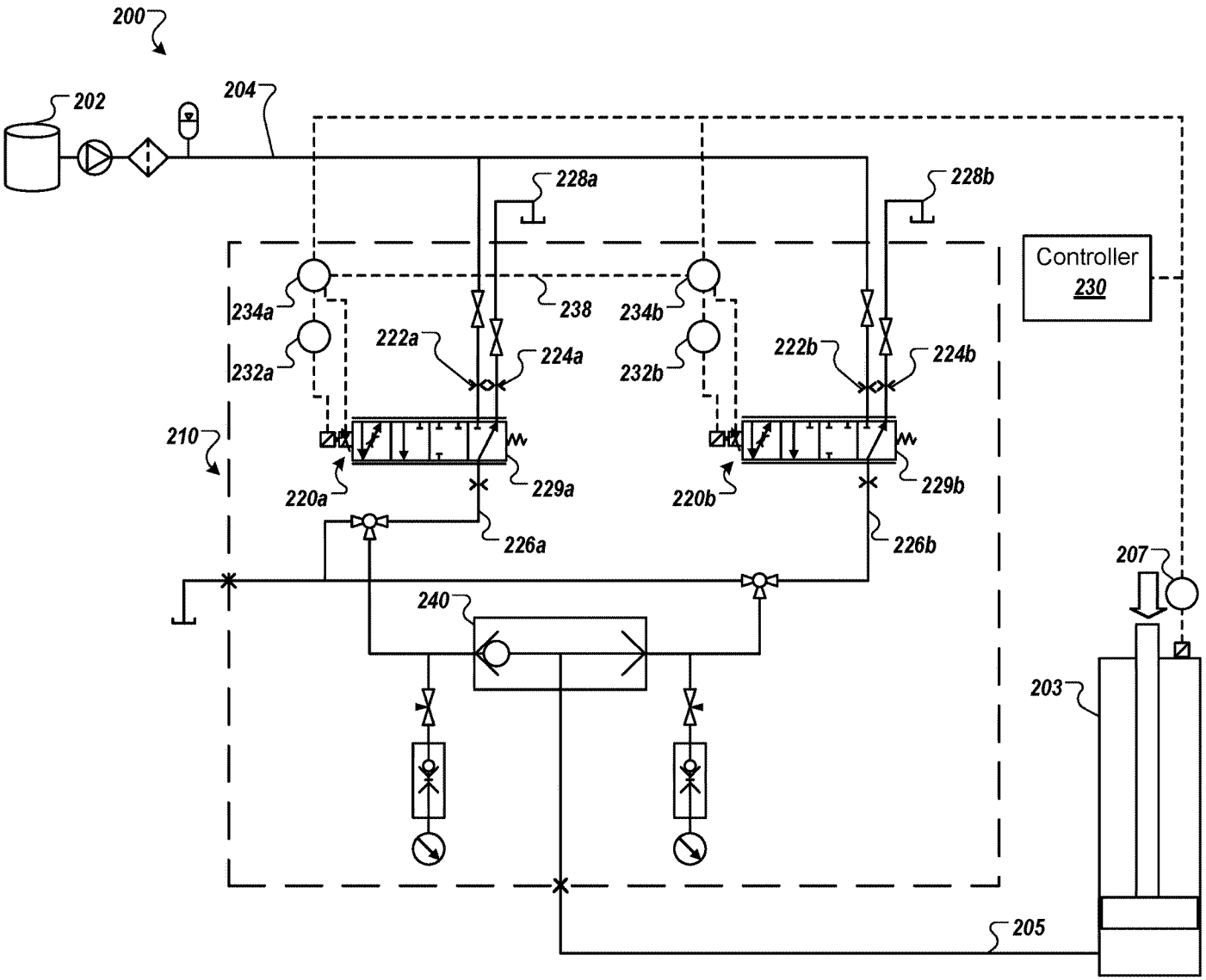
FIG. 2 is a schematic diagram of an example hydraulic control system.

FIG. 2 is a schematic diagram of an example hydraulic control system 200. In some embodiments, the system 200 can be the example system 100 of FIG. 1. The system 200 includes a fluid control system 210 that is configured to control a flow of fluid (e.g., hydraulic fluid) from a fluid reservoir 202 or other fluid pressure source to a fluid actuator 203 (e.g., a hydraulic cylinder, a hydraulic actuator). The fluid reservoir 202 provides fluid to a main fluid supply conduit 204. A main fluid control conduit 205 (e.g., a fluid outlet) is configured to provide fluid communication with a pressure chamber of the fluid actuator 203. A position sensor 207 is configured to provide signals representative of the position or configuration of the fluid actuator 203.

The fluid control system 210 includes an electro hydraulic servo valve (EHSV) 220*a* and an EHSV 220*b*. The configuration of the EHSVs 220*a* and 220*b* will be discussed in more detail in the description of FIGS. 3A-3D.

The EHSV 220*a* includes a fluid supply port 222*a* in fluid communication with the main fluid supply conduit 204, a fluid drain port 224*a* in fluid communication with a drain 228*a*, and a fluid control port 226*a* in fluid communication with the main fluid control conduit 205. The EHSV 220*a* is configured to actuate a closure member 229*a* to selectably provide several configurations that provide and/or block various fluid interconnections between the main fluid control conduit 205, the main fluid supply conduit 204, and the drain 228*a*.

The EHSV 220*a* also includes a valve controller 234*a* and a valve position sensor 232*a* configured to sense the configuration of the closure member 229*a*. The valve controller 234*a* is configured to control the operation of the EHSV 220*a* based on commands from a controller 230 (e.g., priority signals that identify which of the EHSVs is to act as the primary controller and which is to act as the secondary controller), position feedback from the valve position sensor 232*a*, position feedback from the position sensor 207, and a health signal from the EHSV 220*b*. The health signal is communicated over a communication bus 238.

The EHSV 220*b* includes a fluid supply port 222*b* in fluid communication with the main fluid supply conduit 204, a fluid drain port 224*b* in fluid communication with a drain 228*b*, and a fluid control port 226*b* in fluid communication with the main fluid control conduit 205. The EHSV 220*b* is configured to actuate a closure member 229*b* to selectably provide several configurations that provide and/or block various fluid interconnections between the main fluid control conduit 205, the main fluid supply conduit 204, and the drain 228*b*. In some embodiments, the drain 228*a* and the drain 228*b* may be fluidly interconnected (e.g., to provide a fluid return to the fluid reservoir 202).

The EHSV 220*b* also includes a valve controller 234*b* and a valve position sensor 232*b*. The valve controller 234*b* is configured to control the operation of the EHSV 220*b* based on commands from the controller 230 (e.g., priority signals that identify which of the EHSVs is to act as the primary controller and which is to act as the secondary controller), position feedback from the valve position sensor 232*b*, position feedback from the position sensor 207, and a health signal from the EHSV 220*a*. The health signal is communicated over the communication bus 238.

The EHSVs 220*a* and 220*b* are in communication with, or otherwise controlled by, the controller 230. The controller 230 is configured to provide control signals to the EHSVs 220*a* and 220*b* to EHSV command the position demand of the fluid actuator 203 and provide priority signals to them. The controller 230 is also configured to receive feedback signals from the EHSVs 220*a* and 220*b* to determine the actual conditions of the EHSVs 220*a* and 220*b* and the actual position of the fluid actuator 203.

The fluid control port 226*a* and the fluid control port 226*b* are in fluid communication with the main fluid control conduit 205 through a shuttle valve 240. The shuttle valve 240 is configured to selectively provide fluid communication between the main fluid control conduit 205 and a selected one of the fluid control port 226*a* and the fluid control port 226*b*, while blocking fluid communication to the other one of the fluid control port 226*a* and the fluid control port 226*b*. The shuttle valve 240 is configured to select the interconnection based on which of the fluid control port 226*a* and the fluid control port 226*b* is providing the relatively higher fluid pressure.

Under normal operations, the EHSV 220*a* is controlled in order to control actuation of the fluid actuator 203, while the EHSV 220*b* is held in standby. The controller 230 is configured to detect a state of operation of both the EHSV 220*a* and the EHSV 220*b*. In the event of a failure of the primary EHSV or a failure of communications with the primary EHSV, the secondary EHSV is used in order to provide substantially uninterrupted control of the fluid actuator 203.

In some embodiments, a secondary EHSV can be held at below null position, so as to not interfere with shuttle valve position. For example, the fluid control port 226*b* may be disconnected to the fluid supply port 222*b*, but the closure member 229*b* can be positioned close to a fluid communication position in case fast action is needed to allow the EHSV 220*b* take over control from EHSV 220*a*.

In some embodiments, the system 210 can provide demand offset when one of the EHSV's status is unknown (e.g., designated secondary EHSV but in control, healthy link failed). Offset demand on a designated secondary EHSV that is in operation (e.g., due to the other EHSV's condition being unknown) can reduce or avoid hydraulic pressure equalization on the inputs to the shuttle valve 240 and thus increase stable positioning and stable flow on the main fluid control conduit 205.

In some embodiments, the system 210 can be configured to perform air bleeding procedures (e.g., to facilitate online replacement of one of the EHSVs 220*a*-220*b*). For example, one or both of the EHSVs 220*a*-220*b* can be actuated in a manner that permits or promotes a release of air from within a closed cavity (e.g., air trapped inside a new installed, dry EHSV), while not interfering with normal cylinder operation. Examples of air bleeding procedures will be discussed in more detail in the descriptions of FIGS. 6A-8.

FIGS. 3A-3D are schematic diagrams of an example EHSV 300 in various operational configurations. In some embodiments, the EHSV 300 can be the example EHSV module 120*a* of FIG. 1, the example EHSV module 120*b*, the example EHSV 220*a* of FIG. 2, and/or the example EHSV 220*b*. The EHSV 300 includes a fluid supply port 322 configured to be in fluid communication with a supply conduit (e.g., the main fluid supply conduit 204), a fluid drain port 324 configured to be in fluid communication with a drain, and a fluid control port 326 configured to be in fluid communication with a main fluid control conduit (e.g., the main fluid control conduit 205) through the shuttle valve 240. The EHSV 300 is configured to selectably provide several configurations that provide and/or block various fluid interconnections between the main fluid control conduit, the main fluid supply conduit, and the drain.

The EHSV 300 includes a housing 350 and a closure member 360. The closure member 360 is positioned relative to the housing 350 by an actuator 370. The actuator 370 is configured to be controlled by a controller, such as the example valve controller 234*a* or the example valve controller 234*b* of FIG. 2. The EHSV 300 also includes a sensor 380 that is configured to provide a signal that represents the position of the closure member 360 relative to the housing 350, or the configuration of the EHSV 300. The sensor 380 is configured to provide the sensor signal as feedback to a controller, such as the example valve controller 234*a* or the example valve controller 234*b*.

The EHSV 300 is configured to provide four fluid interconnection configurations. In a configuration 390*a*, shown in FIG. 3A, the fluid control port 326 is fluidically connected to the fluid drain port 324 while the fluid supply port 322 is fluidically blocked. In a configuration 390*b*, shown in FIG. 3B, the fluid control port 326, the fluid drain port 324, and the fluid supply port 322 are all fluidically blocked (e.g., a null position). In a configuration 390*c*, shown in FIG. 3C, the fluid control port 326 is fluidically connected to the fluid supply port 322 while the fluid drain port 324 is fluidically blocked.

Figure 3A:
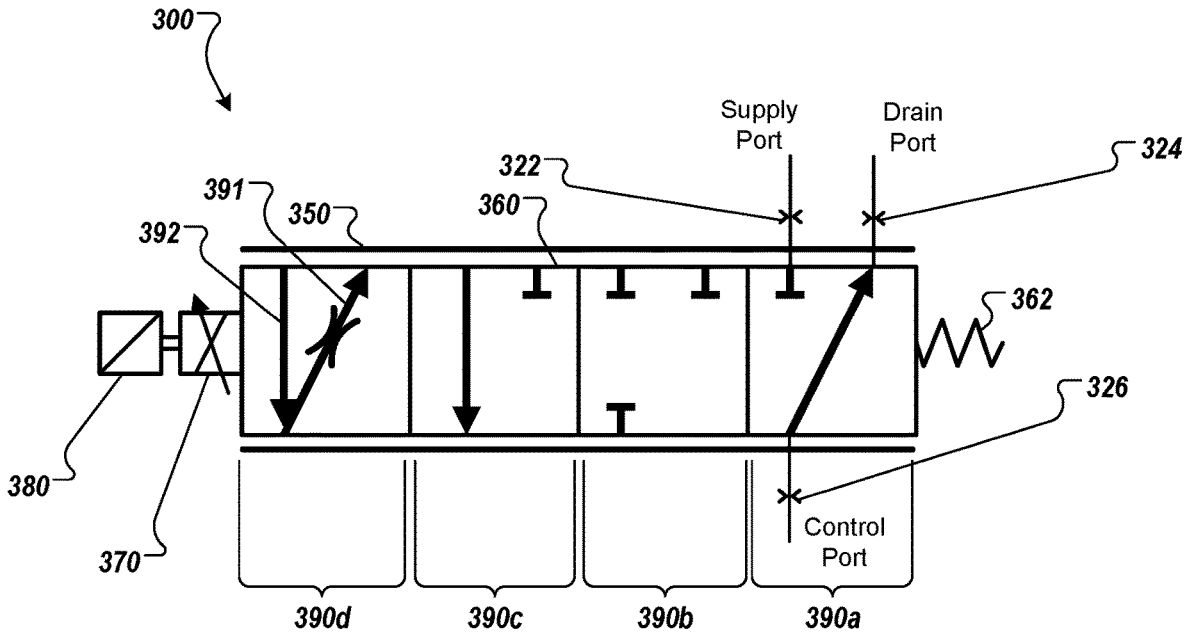
FIGS. 3A-3D are schematic diagrams of an example electro-hydraulic servo valve in various operational configurations.
Figure 3B:
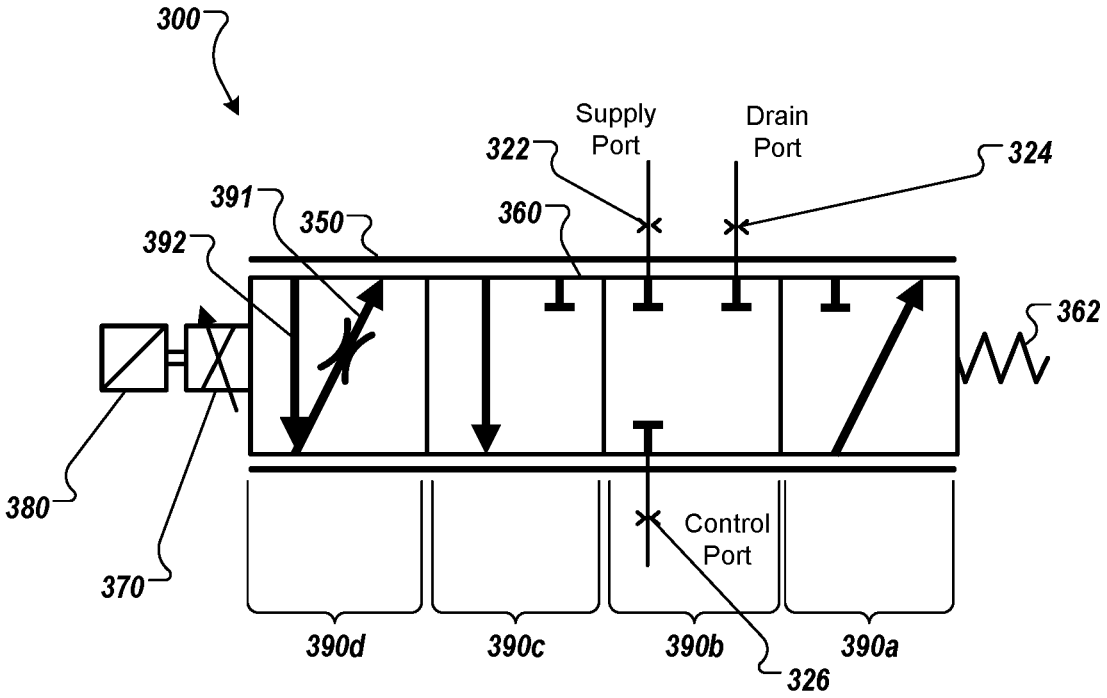
Figure 3C:
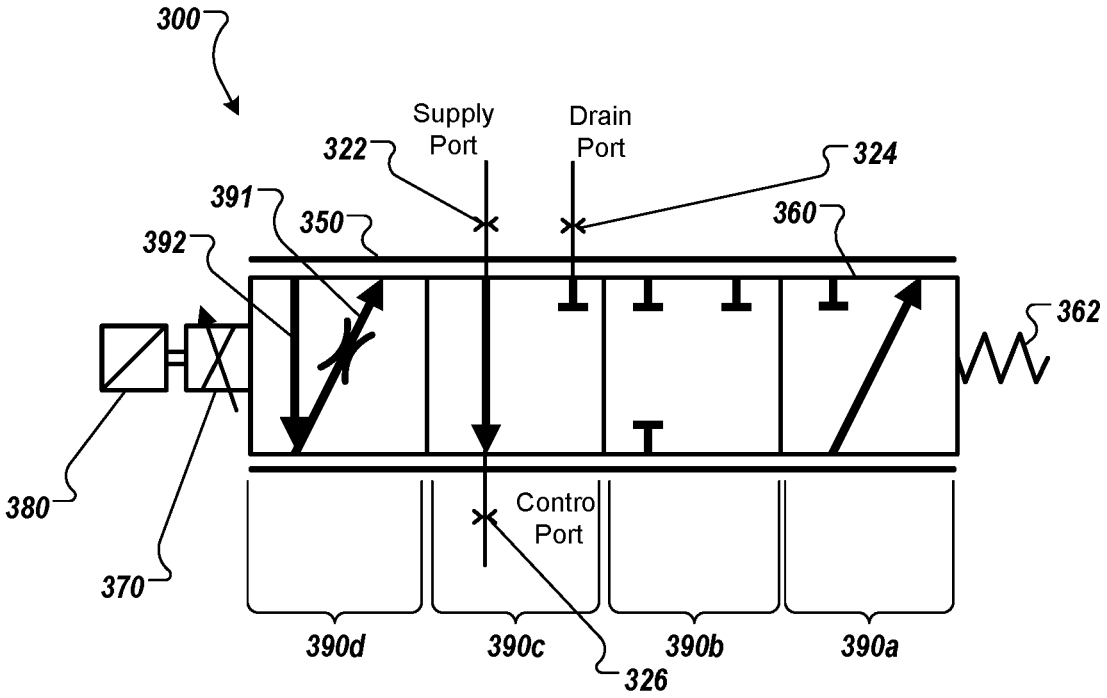
Figure 3D:
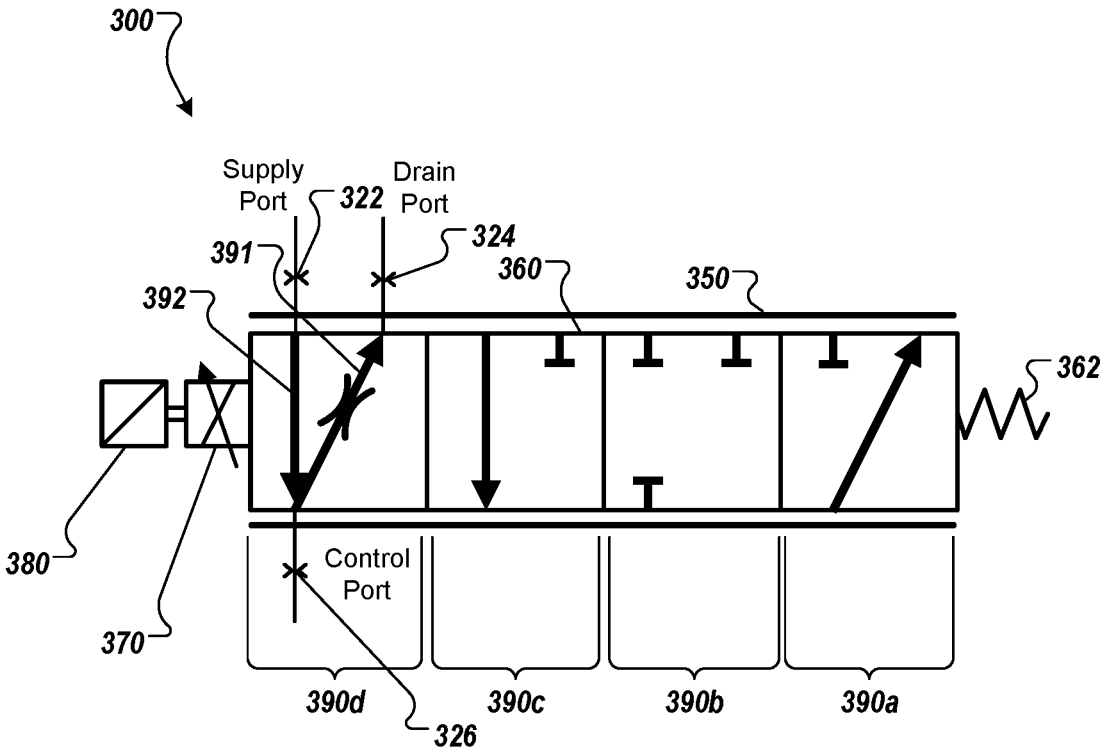

In a configuration 390*d*, shown in FIG. 3D, the fluid control port 326 is fluidically connected to both the fluid drain port 324 and the fluid supply port 322. In the configuration 390*d*, a fluid connection 391 between the fluid control port 326 and the fluid drain port 324 is relatively (e.g., substantially) more restrictive to fluid flow than a fluid connection 392 between the fluid control port 326 and the fluid supply port 322.

In various circumstances, air may become present in the fluid lines that pass through the EHSV 300. For example, air may enter the fluid circuit during maintenance, or during rapid actuation of the example actuator 230 (e.g., air may leak past hydraulic seals that define the pressure chamber of the actuator). Such air is generally unwanted, as it can degrade the performance of the actuator being controlled (e.g., sponginess or springiness due to the relative compressibility of gaseous fluids compared to liquids).

In use, the EHSV 300 can be configured to the configuration 390*d* in order to purge (e.g., bleed) air from the fluid pathways inside and/or downstream from the EHSV 300. In previous designs, trapped air would be purged from the fluid circuit manually. Such previous processes would typically require operational downtime and/or manual access to the fluid lines (e.g., ground maintenance). In the illustrated example, air trapped in the fluid is able to exit to the fluid drain port 324 through the fluid connection 391 more easily than can the surrounding fluid, thus allowing the air to be purged from the fluid circuit as a mechanical or automated function of the EHSV 300 instead of requiring manual access to the fluid circuit. In some implementations, the EHSV that is to be air-bled can be shifted out of process control, and such operations can be performed by its redundant companion EHSV while the EHSV in need of bleeding can be cleared of air.

The EHSV 300 also includes a bias member 362 configured to urge the closure member 360 into a predetermined (e.g., failsafe) configuration. In the illustrated example, the failsafe configuration is the configuration 390*a*, but in other embodiments the failsafe configuration can be any one of the configurations 390*a*-390*d*. In some embodiments, the bias member 362 can be configured to urge the closure member 360 away from a predetermined one of the configurations 390*a*-390*d* (e.g., to prevent accidental use of the configuration 390*d*).

Figure 4:
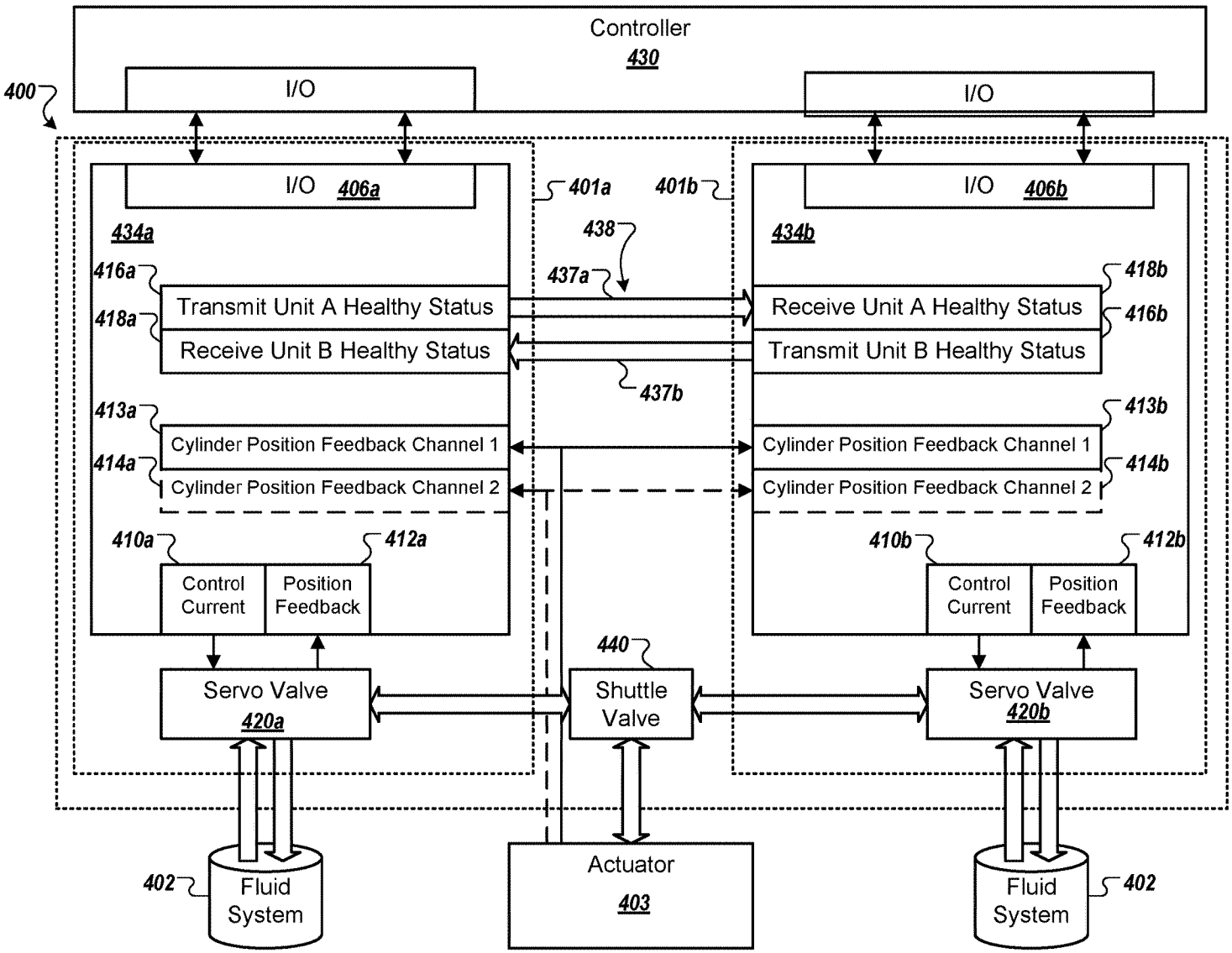
FIG. 4 shows an example schematic view of an example hydraulic control system.

FIG. 4 shows an example schematic view of an example hydraulic control system 400. In some embodiments, the system 400 can be part of the system 100 of FIG. 1 or the system 200 of FIG. 2.

The system 400 includes an EHSV module 401*a* and an EHSV module 401*b*. The EHSV module 401*a* includes a valve controller 434*a* and an EHSV 420*a*, and the EHSV module 401*b* includes a valve controller 434*b* and an EHSV 420*b*. In general, the EHSV modules 401*a* and 401*b* are configured to be redundant, substantially self-contained, replaceable modules within the system 400.

The valve controller 434*a* includes a control current output 410*a* that actuates the EHSV 420*a*, and a position feedback input 412*a* that is configured to receive position feedback sensor signals from the EHSV 420*a* (e.g., from a variable displacement transformer linked to a moveable closure member of the valve). The valve controller 434*a* also includes a position feedback input 413*a* and a position feedback input 414*a* that are configured to receive position feedback sensor signals from the fluid actuator 403 (e.g., from a variable displacement transformer or other appropriate position sensor linked to a moveable component or to an output of the actuator).

In some embodiments, the fluid actuator 403 can be configured with redundant position sensors, and the position feedback input 413*a* and a position feedback input 414*a* can be configured to read the redundant signals provided by the redundant sensors. The valve controller 434*a* also includes an input/output module 406*a* that is configured to receive commands and demands from the controller 430, and send and/or receive feedback and/or status signals to/from the controller 430.

The valve controller 434*b* includes a control current output 410*b*, a position feedback input 412*b*, a position feedback input 413*b*, a position feedback input 414*b*, and an input/output module 406*b* that perform functions that are substantially similar to their counterparts in the valve controller 434*a*. In some embodiments, the position feedback inputs 413*a* and 413*b* can be configured to receive the same position feedback signal, and the position feedback inputs 414*a* and 414*b* can be configured to receive the same redundant position feedback signal.

The valve controller 434*a* includes a health status transmitter 416*a* and a health status receiver 418*a*, and valve controller 434*b* includes a health status transmitter 416*b* and a health status receiver 418*b*. The health status transmitter 416*a* is configured to transmit a health status signal 437*a* over a communication bus 438, and the health status receiver 418*b* is configured to receive the health status signal 437*a*. The health status transmitter 416*b* is configured to transmit a health status signal 437*b* over the communication bus 438, and the health status receiver 418*a* is configured to receive the health status signal 437*b*. Such a configuration allows the valve controllers 434*a* and 434*b* to monitor each other's status.

The valve controller 434*a* is configured to provide closed-loop control of the EHSV 420*a* and, by extension, the fluid actuator 403, by providing control current at the control current output 410*a* based on a demand signal (e.g., received from the controller 430 at the I/O module 406*a*), position feedback signals received at the position feedback inputs 412*a*, 413*a*, and 414*a*, the health status of the EHSV module 401*a*, and the health status signal 437*b*. The valve controller 434*b* is configured to provide closed-loop control of the EHSV 420*b* and, by extension, the fluid actuator 403, by providing control current at the control current output 410*b* based on the demand signal (e.g., received from the controller 430 at the I/O module 406*a*), position feedback signals received at the position feedback inputs 412*b*, 413*b*, and 414*b*, the health status of the EHSV module 401*b*, and the health status signal 437*a*.

The EHSV modules 401*a* and 401*b* are configured to receive commands (e.g., demand signals) from the controller 430 to control fluid flow from a fluid supply 402 to a fluid actuator 403 (e.g., a hydraulic actuator or cylinder) through a shuttle valve 440. The shuttle valve 440 is configured to fluidically connect whichever of the EHSV 420*a* or the EHSV 420*b* is providing the highest output pressure. In use, one of the EHSVs 420*a* or 420*b* is operated as a primary EHSV providing operational flow and pressure, while the other EHSV is operated as a secondary (e.g., backup) unit. In some implementations, the secondary EHSV may be operated in parallel with the primary EHSV, but at a slightly lower position demand (e.g., enough to prevent switchover of the shuttle valve away from the primary EHSV). In the event of a sudden failure of the primary EHSV, the fluid pressure from the primary EHSV may drop abruptly. By keeping the secondary EHSV online but controlling slightly low (e.g. based on a modification of the demand signal), the shuttle valve 440 can switch over based on the still-present secondary pressure with little interference with the operation of the actuator, allowing the secondary EHSV to take control immediately and then identify its new status as the controlling EHSV. Once the secondary EHSV recognizes its new status (e.g., based on a response to a received health signal and/or a signal from the controller 430), it can remove the modification to its own demand so it controls cylinder position to follow the demanded position without the slight reduction caused by the modification.

In some implementations, a "healthy" signal can be a signal that is transmitted when the transmitter identifies itself as operating normally (e.g., an operable condition absent of failure, without identified malfunction). Since in some implementations, notification by a valve controller (and subsequent detection by a companion valve controller) can be of highest priority, of which a change in that status needs to be communicated quickly. The healthy signal can be transmitted with the relatively fastest frequency that can be correctly recognized by a receiver, and any further modification detected on the receiver side can be detected as a failure of sender.

In some implementations, a "slow fail" signal can be a signal that is transmitted when the transmitter identifies itself as experiencing or predicting a malfunction, failure, or other condition that is addressable by a slow, controlled shutdown of a corresponding one of the EHSVs. In some implementations, a "fast fail" signal can be a signal that is transmitted when the transmitter identifies itself as experiencing or predicting a malfunction, failure, or other condition that is addressable by a rapid shutdown of the corresponding one of the EHSVs. In some implementations, the signals can be the health signals received by the example EHSV modules 120*a* and 120*b*, by the example valve controllers 234*a* and 234*b*, or by the example valve controllers 434*a* and 434*b*, from their corresponding redundancy devices. In general, health signals can be received and interpreted by the receiver to determine several different states of health of the sending device and/or the communication bus used to communicate the signal.

In some implementations, the operation of the example fluid control system 210 can be based, at least in part, on health signals. For example, the system 210 can operate in a normal operation mode based on identification of a healthy signal). In an example of normal operations, a selected valve controller takes control over the position of the fluid actuator 203 by modulating passages from main fluid supply conduit 204 to the fluid actuator 203 and from fluid actuator 203 to the drain ports 224*a* and 224*b*.

The unit that is not performing control operations while being in standby provides a continuously opened passage to drain at limited opening so its side of the shuttle valve 240 can have a low pressure equal to drain pressure. Servo positioning keeps the corresponding closure member 229*a* or 229*b* close to the null position (e.g., configuration 390*b*) in case fast action is needed to take over control. The unit that is not performing control operations opens to full drain in case the demanded position of the fluid actuator 203 is close to zero. In some implementations, this is to make the full flow drain from its side of shuttle valve 240 and allow the controlling EHSV to realize positioning of the fluid actuator 203 without interference (e.g., mostly during fast governor valve shutdown).

Both of the valve controllers 234*a* and 234*b* receive position demand from the controller 230, and both valve controllers 234*a* and 234*b* are configured to receive two (e.g., redundant) position feedback signals from the fluid actuator 203 (e.g., both valve controllers get the same value of demand and position feedback all the time). The valve controllers 234*a* and 234*b* transmit health signals to each other over separate lines to inform each other that they are healthy (e.g., operable, not in failure), experiencing a slow fail (e.g., faulty but the failure is controlled so the shutdown of the unit is not severe), or experiencing a fast fail (e.g., faulty in critical way, shutdown of the unit needs to be performed with its maximum speed). Other states of signals are considered as line failures, however it is the receiver that identifies whether the line failure is a type of short circuit, a disconnection, or noise.

In some implementations, the system 210 can determine that the unit that is designated to be in control of the process has failed. Thanks to the exchange of status information, there is no need for action by an external system (e.g., the controller 230) in case of failure in the controlling valve controller 234*a* or 234*b* or the controlling EHSV 220*a* or 220*b*. The failed valve controller that is in control can determine that it has a fault and is unable to continue controlling the fluid actuator 203. The controlling valve controller communicates this status to the standby valve controller by altering its transmitted health signal. The designated standby valve controller takes control immediately upon identification of the changed health status. As some upset of positioning is expected, the standby unit adds boost into its servo valve position when taking control, to better fulfill a demanded position of the fluid actuator 203. Once it has taken control, the designated standby valve controller communicates with the controller 230 to notify it that it is now operating as the primary controller for operations of the controlled process. The failed valve controller communicates with the controller 230 to notify it of the fault and that it is no longer in operation.

In some implementations, the system 210 can determine that the unit that is currently in standby has failed. In some implementations, the failed secondary valve controller can inform the other unit that it is faulty and thus unable to take over control if needed. The failed standby unit also notifies the controller 230 that it is faulty. The current primary valve controller that is in control is informed that the other unit is inoperable, and will keep its own control over the position of the fluid actuator 203 despite whatever mode is demanded from controller 230. For example, even if the valve controller that is in control is commanded to transfer to standby operation, it will stay in control to maintain continuity of the controlled operation. Based on the internal exchange of health status information, there is no need for action by an external system (e.g., the controller 230) in case of standby EHSV failure.

In some implementations, a valve controller can identify a communication link failure and respond. For example, the standby unit can respond by outputting an alarm signal (e.g., to the controller 230) to indicate a fault of the communication bus 238. When the standby unit senses that the health signal is not recognizable (e.g., short circuit, disconnection, noisy signal), it then attempts to take over control, and identifies itself as acting as the primary valve controller that is in charge of controlling the fluid actuator 203. When the reason for the communication failure is unknown (e.g., cannot determine if the other valve controller has failed, or if it is only a wiring issue and the other unit is still functioning normally), the secondary valve controller can modify its demand by subtracting a small offset (e.g., about 2% of fluid actuator full stroke). In some implementations, this demand modification can create a slightly lower pressure on its side of the shuttle valve 240, so as to not interfere with the operation of the primary EHSV if the two units are attempting to control the fluid actuator 203 at the same time. Offset on the demand signal can reduce or avoid the hydraulic pressure equalization on the inputs of the shuttle valve 240 and can help maintain stable positioning and/or stable flow on the main fluid control conduit 205.

In another example, the primary valve controller can determine a fault in health signal communications from the standby valve controller. In some implementations, the primary valve controller can respond by outputting an alarm signal (e.g., to the controller 230) to indicate a fault of the communication bus 238. The primary valve controller can keep operational control of the fluid actuator 203. Since the reason for the fault may not be entirely known, the primary unit may assume that the other unit might not be operable, and will keep operation and control over the fluid actuator 203 even if the controller 230 commands it to transfer to secondary or backup operation. Since the reason for the communication failure is unknown the formerly primary valve controller can modify its demand. For example, the valve controller 234*a* or 234*b* can modify its demand by subtracting a small offset (e.g., about 2% of fluid actuator full stroke).

In some implementations, the valve controllers 234*a*-234*b* can be commanded (e.g., by the controller 230) to trade their operating roles. For example, an operator may access a control panel or other input to the controller 230 to command an immediate swap of the primary/secondary designations of the two units. In some implementations, if any overlap of signal is foreseen, both units may be set to act as primary units first, before setting one as secondary (e.g., it may be preferable to have both units designated as primary for a short while than to have both units designated as secondary). In such an example, both units are operable, healthy, and receive information that the other unit is healthy too. In such an example, both units can execute exactly what is given as designation from controller 230. The secondary unit will transfer to primary operational mode based on a command from the controller 230, and because some minimal upset to the positon of the fluid actuator 203 is expected during the control switch, the unit can apply additional boost on its position control of its corresponding EHSV to compensate for process upset. In response to the control transfer signal from the controller 230, the former primary valve controller will switch into secondary control mode, and it can control its corresponding EHSV to a configuration having a slight drain. In some implementations, both units can indicate their current primary/secondary state through discrete communication outputs (e.g., to the controller 230).

In some implementations, the valve controllers 234*a*-234*b* can perform operations that prevent or reduce build-up (e.g., dirt, silt) that may have accumulated in the EHSVs 220*a*-220*b*. Depending on the site condition and quality of the hydraulic oil, it can be desirable to perform a build-up reduction process. For example, periodically (e.g., daily, weekly, other period), the valve controllers 234*a*-234*b* can oscillate their corresponding closure members 229*a*-229*b* by a small amount (e.g., a single cycle) to allow accumulated contamination to release. In some implementations, this function may be useful where one or both of the EHSV's 220*a*-220*b* are held in one stable configuration for a long period of time. When decontamination is commanded, the primary valve controller can respond by moving its corresponding closure member in a short position step down and then by a similar step up above desired servo valve position (e.g., use of opposite, semi-symmetrical movements can reduce impact on actuator position). Since the secondary unit is continuously at drain and typically will stay at steady position for a long time, a similar operation may also be implemented. Since the secondary unit is configured to not interfere with operation by the primary unit, its output pressure needs to remain below the output pressure of the primary unit at the shuttle valve 240. In some implementations, this can be taken into account by having the secondary valve controller respond to its own designation as a secondary unit, and perform the build-up reduction process by only short stepping down, and in some examples by also maintaining that position longer than a primary unit would do, and then return back to normal position. The positive pulse is not executed, to avoid upsetting the system operation.

In some implementations, parts or all of an EHSV module (e.g., the example EHSV modules 120*a*-120*b*, the example EHSVs 220*a*-220*b*, the valve controllers 234*a*-234*b*) can be replaced online (e.g., one redundant part of the system can be replaced while the other maintains operational control). Referring to FIG. 1, an operator can use the isolation valves 140*a*-140*b*, the pressure gauges 115*a*-115*b*, and software tools to facilitate an online replacement of a redundant component. The mechanical design of the system 100 reduces the open cavity volume of the assembly and reduces space in which air can become trapped during online replacement. Parameterization of the unit can be copied from the disassembled servo or from an earlier-stored configuration file. Having the configuration file loaded to a newly installed servo, there is a reduced need to configure it manually and there is a reduced need to perform cylinder calibration on the installed servo. In some embodiments, monitoring software (e.g., a customer service tool) can be included to provide monitoring and to verify proper operation of newly installed EHSVs before they are hydraulically joined to the operational (e.g., live, running, pressurized) system by opening isolation valves.

Returning briefly again to FIG. 2, the valve controllers 234*a*-234*b* are configured to be able to perform an automatic air bleeding procedure that can be performed after an online replacement. The procedure is configured to releasing the air from a closed cavity (e.g., air trapped in a newly installed, dry EHSV), while substantially not interfering with normal operation of the fluid actuator 203.

Figure 5:
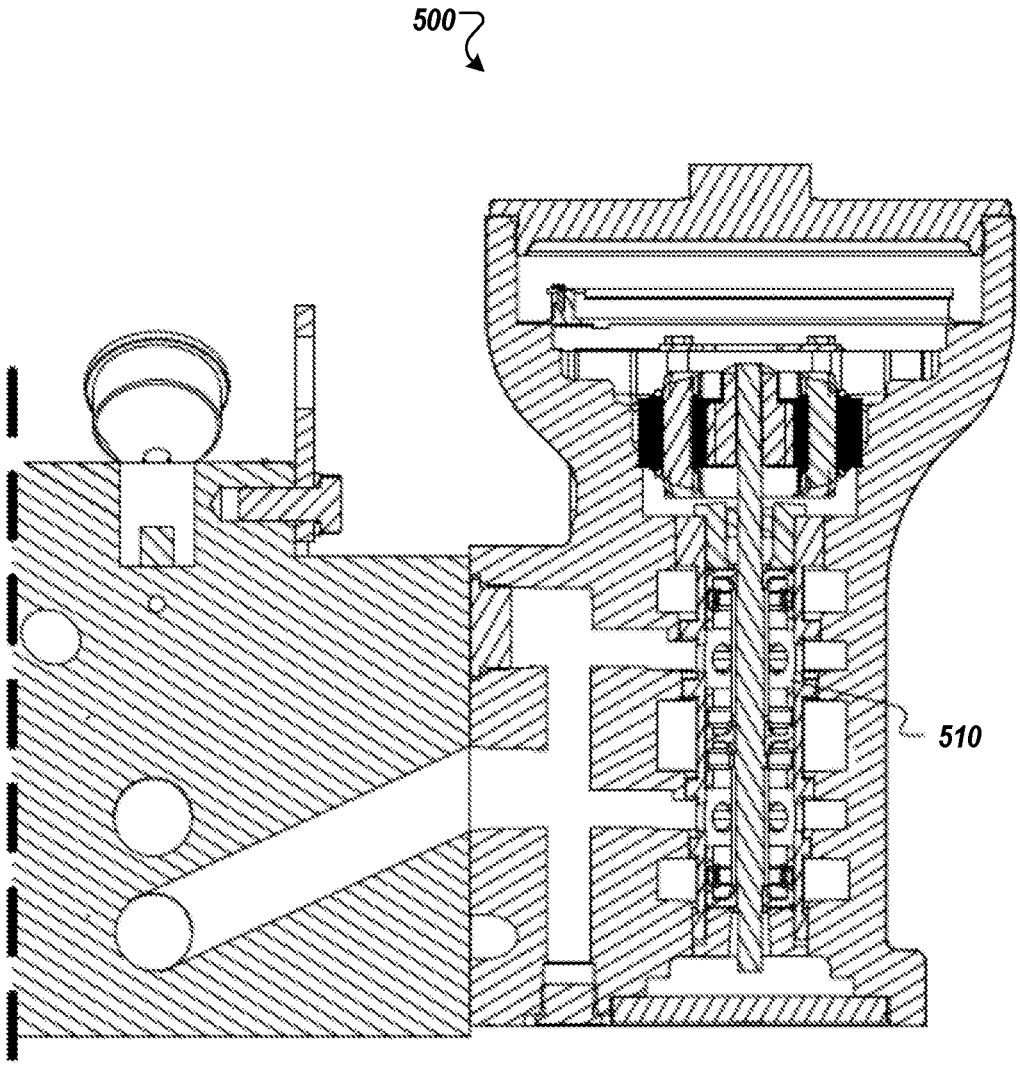
FIG. 5 is a cross-sectional view of an example hydraulic servo valve.

Referring now to FIG. 5, a cross-sectional view of an example hydraulic servo valve (EHSV) 500 is shown. In some embodiments, the EHSV 500 can be the example EHSV module 120*a* or 120*b* of FIG. 1, the example EHSV 220*a* or 220*b* of FIG. 2, the example EHSV 300 of FIGS. 3A-3D, or the example EHSV 420*a* or 420*b* of FIG. 4. The air bleeding procedure described above utilizes additional holes 615 (not visible in FIG. 5, see FIGS. 6A-6D) provided in a closure member 510 (e.g., valve spool) of the EHSV 500. The holes 615 provide small oil paths for flushing out air that can be trapped or can accumulate within the EHSV 500. The valve controllers 234*a*-234*b* are configured to move the closure member 510 with dynamic movements of different lengths to create pressure differences and flow that releases trapped air. Examples of such movements are described in more detail in the descriptions of FIGS. 7A-7E.

Figure 6A:
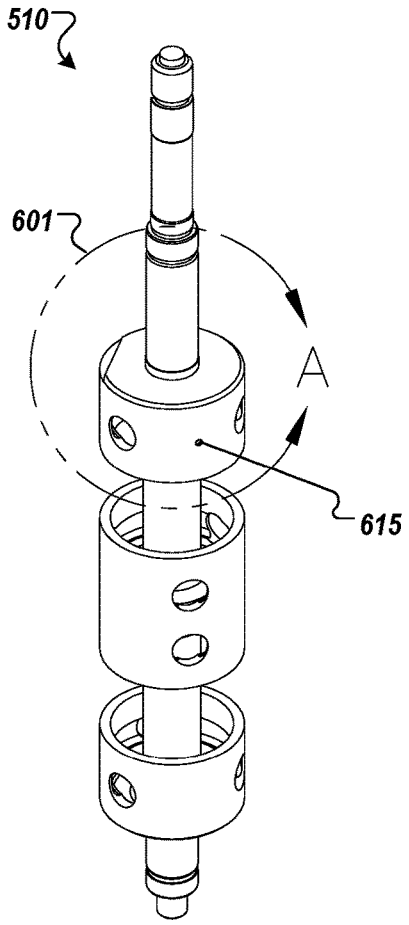
FIGS. 6A-6D are various views of an example closure member.
Figure 6B:
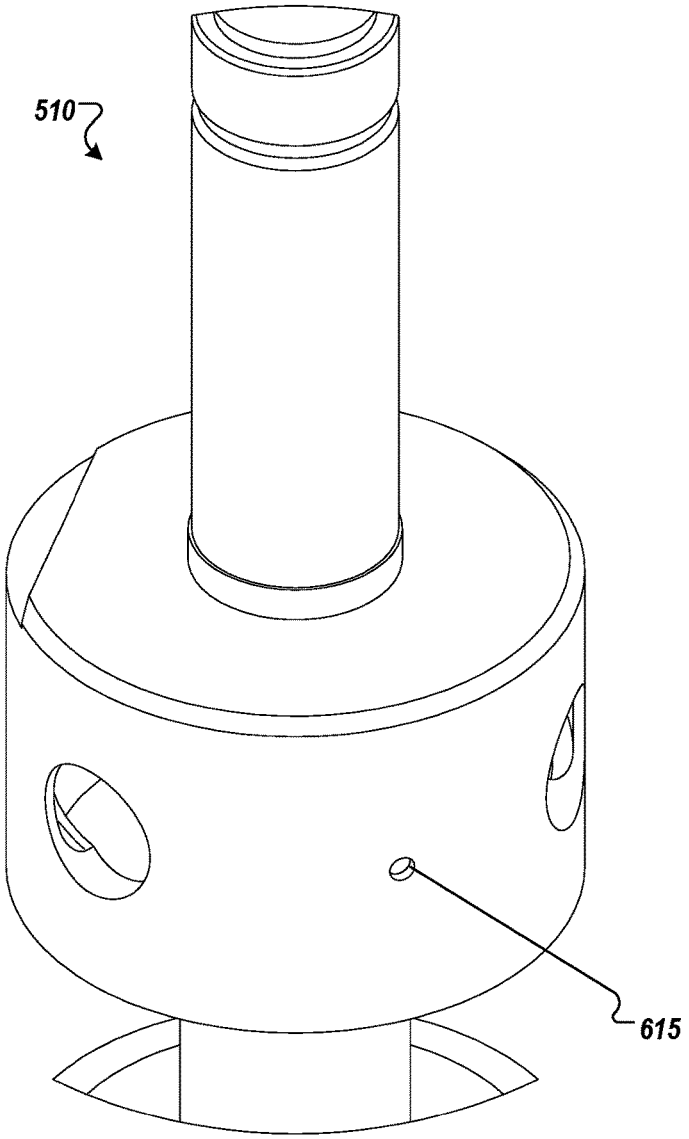
Figure 6C:
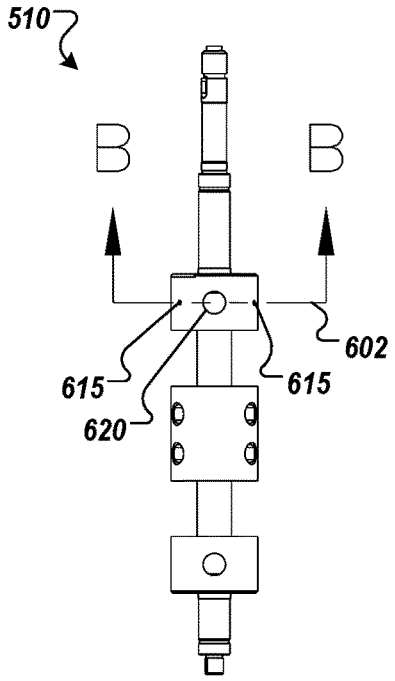
Figure 6D:
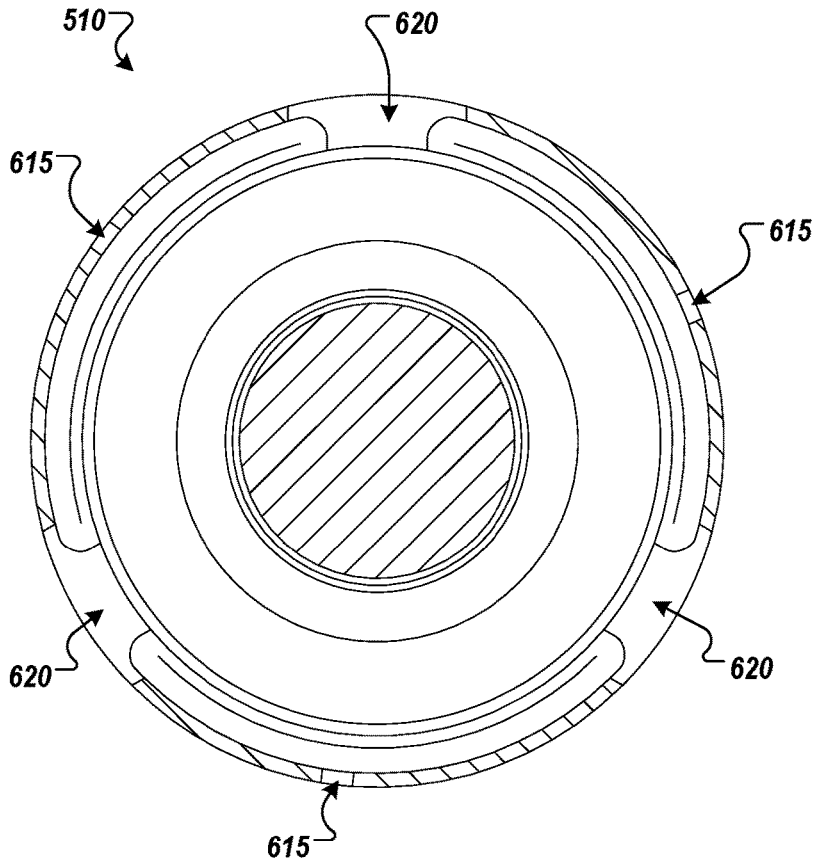

FIGS. 6A-6D are various views of the example closure member 510 of FIG. 5. In some embodiments, the closure member 510 can be the example closure member 229*a* or 229*b* of FIG. 2, or the example closure member 360 of FIGS. 3A-3D. FIG. 6A shows a perspective view of the closure member 510 and one of the holes 615. A portion 601 of the closure member 510 is shown enlarged in FIG. 6B. FIG. 6C shows a side view of the closure member 510 and two of the holes 615. A cross-sectional view of the closure member 510 taken through a section 602 is shown enlarged in FIG. 6D.

A collection of holes 620 are provided as a selectably controllable (e.g., by partly rotating the closure member 510 within the EHSV 500) primary fluid flow path through the closure member 510 (e.g., between various combinations of the fluid source, drain, and/or control lines), while the holes 615 are configured to provide a restricted flow path (e.g., to allow air to purge to drain). In some embodiments, the holes 620 can provide the example fluid connection 392 of FIGS. 3A-3D, while the holes 615 can provide the example fluid connection 391. The holes 615 provide limited passages that make it possible to create controlled bleeding flows from a fluid supply, through a control line, to a drain port. Such construction allows air residuals to be evacuated when a rapid flow (e.g., high volume flushing) process is not allowable. The example design incorporates three such bleeding holes to allow for the release of air trapped inside the closure member.

FIGS. 7A-7E are graphs of servo valve demands during an example air bleeding process. In use, a closure member such as the example closure member 229*a* or 229*b* of FIG. 2, the example closure member 360 of FIGS. 3A-3D, or the example closure member 510 of FIGS. 5-6D can be operated through one or more predetermined sequences of operations configured to purge air that is trapped within the closure member 510. In some embodiments, the purging process can be predetermined for a specific application. In some embodiments, multiple purging processes can be determined for multiple specific applications.

In an example implementation in which control pressure is less than or equal to 289 psig, the closure member can be operated in five phases.

Phase 1: The closure member can be closed (e.g., spool position=0%, drain position, configuration 390*a*) for 0.5 seconds and then opened (e.g., spool position=100%, flush position, configuration 390*d*) for 0.0625 seconds. During this phase, the closure member can be moved at a rate of 750%/sec (e.g., full transition from 0% to 100% can take about 133 ms, where 100% represent the travel between minimal and maximal position of the closure member). This movement can be repeated for 500 cycles. In some implementations, this process can be visualized as the graph 700*a* of FIG. 7A. In phase 1, dynamic pressure changes cause residual air to mix with oil, and depending on supply pressure an oil-air foam may be created.

Phase 2: The closure member can be closed (e.g., configuration 390*a*) for 1 s and then opened (e.g., configuration 390*d*) for 1 s. During this phase, the closure member can be moved at a rate of 750%/sec. This movement can be repeated for 300 cycles. In some implementations, this process can be visualized as the graph 700*b* of FIG. 7B. In phase 2, the air-oil mixture is stabilized, more air residuals are pushed out of the bleeding holes and internal unit leakage in the form of small bubbles in oil or in foam.

Phase 3: The closure member can be closed (e.g., configuration 390*a*) for 0.5 s and then opened (e.g., configuration 390*d*) for 0.0625 s. During this phase, the closure member can be moved at a rate of 750%/sec. This movement can be repeated for 250 cycles. In some implementations, this process can be visualized as the graph 700*c* of FIG. 7C.

Phase 4: The closure member can be closed (e.g., configuration 390*a*) for 10 s and then opened (e.g., configuration 390*d*) for 10 s. During this phase, the closure member can be moved at a rate of 750%/sec. This movement can be repeated for 20 cycles. In some implementations, this process can be visualized as the graph 700*d* of FIG. 7D.

Phase 5: The closure member can be closed (e.g., configuration 390*d*) for 10 s and then opened (e.g., configuration 390*d*) for 120 s. During this phase, the closure member can be moved at a rate of 25%/sec. This movement can be performed one or more times (e.g., three, five, ten, or another other appropriate number of cycles). In some implementations, this process can be visualized as the graph 700*e* of FIG. 7E.

The five phases just described, when performed sequentially, can provide an air purging process that can be completed in about 30 minutes.

In another example implementation in which control pressure is greater than 289 psig, the closure member can be operated in another example five phases:

Phase 1: The closure member can be closed (e.g., spool position=0%, configuration 390*a*) for 0.5 seconds and then opened (e.g., spool position=100%, configuration 390*d*) for 0.0625 seconds. During this phase, the closure member can be moved at a rate of 750%/sec. This movement can be repeated for 300 cycles.

Phase 2: The closure member can be closed (e.g., configuration 390*a*) for 1 s and then opened (e.g., configuration 390*d*) for 1 s. During this phase, the closure member can be moved at a rate of 750%/sec. This movement can be repeated for 180 cycles.

Phase 3: The closure member can be closed (e.g., configuration 390*a*) for 0.5 s and then opened (e.g., configuration 390*d*) for 0.0625 s. During this phase, the closure member can be moved at a rate of 750%/sec. This movement can be repeated for 150 cycles.

Phase 4: The closure member can be closed (e.g., configuration 390*a*) for 10 s and then opened (e.g., configuration 390*d*) for 10 s. During this phase, the closure member can be moved at a rate of 750%/sec. This movement can be repeated for 12 cycles.

Phase 5: The closure member can be closed (e.g., configuration 390*a*) for 10 s and then opened (e.g., configuration 390*d*) for 120 s. During this phase, the closure member can be moved at a rate of 25%/sec. This movement can be performed one or more times (e.g., three, five, ten, or another other appropriate number of cycles).

The five phases just described, when performed sequentially, can provide an air purging process that can be completed in about 20 minutes.

As mentioned above, these are just two examples of a large number of possible combinations having greater or fewer phases, longer or shorter open and close (e.g., flushing and drain) times, faster or slower actuation speeds, and/or greater or fewer cycles per phase.

One of the benefits of performing the on-line air bleeding is that it is possible to bleed the air from closed cavities without using openings such vent valves. For example, it can be dangerous to release pressurized oil with air residuals that is being provided to a running process.

Furthermore, the purging configuration may be selected, and the purging operation may be performed, during normal operations if necessary. For example, the configuration 390*c* can be a configuration that provides pressurized fluid to actuate an actuator. If it is determined (e.g., manually or automatically) that purging is needed, the valve 300 can be switched into the configuration 390*d*. The configuration 390*d* still provides the pressurized fluid to the actuator through the fluid connection 392, but also provides the fluid connection 391 for trapped air to escape.

Figure 8:
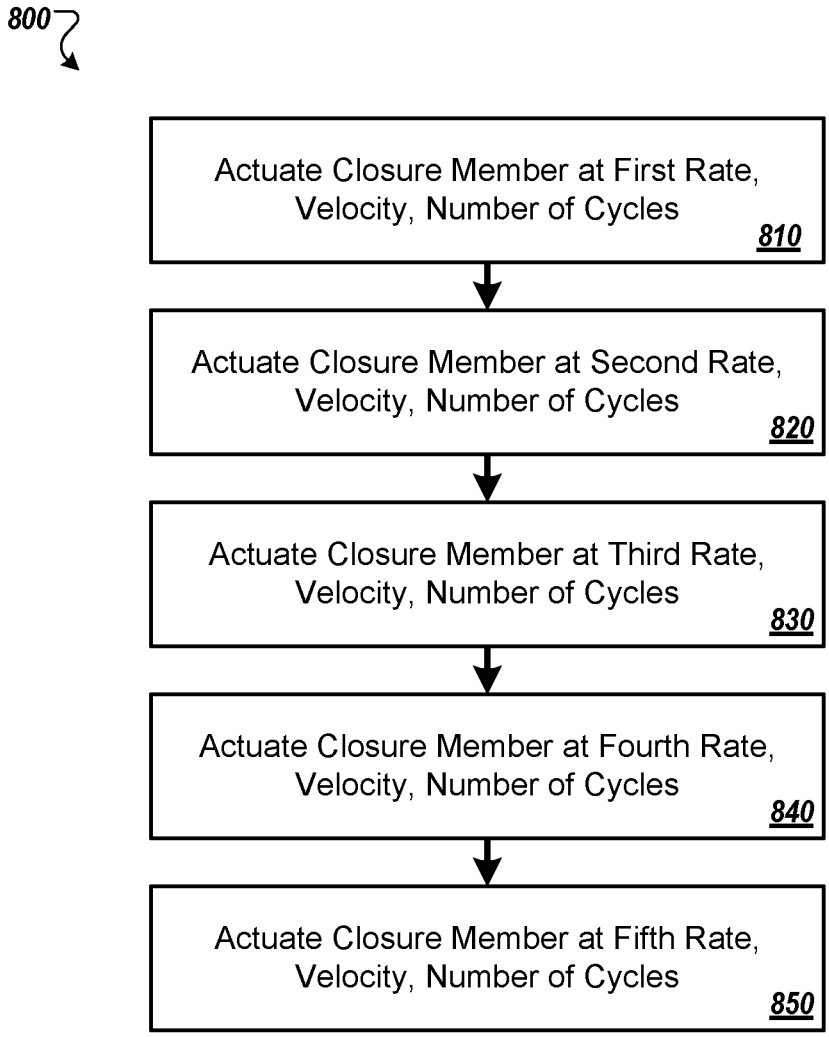
FIG. 8 is a flow diagram of an example air bleeding process.

FIG. 8 is a flow diagram of an example air bleeding process 800. In some implementations, the process 800 can be performed by the example hydraulic control system 100 of FIG. 1, the example hydraulic control system 200 of FIG. 2, or the example hydraulic control system 400 of FIG. 4.

At 810, a closure member of a valve assembly is actuated at a predetermined first velocity a predetermined first number of cycles between a first configuration (e.g., configuration 390*a*), in which fluid flow is permitted from control port to drain port for a predetermined first drain period (e.g., held in configuration 390*a*), and a second configuration (e.g., configuration 390*d*) in which fluid flow is permitted from supply to control port and from control port to drain for a predetermined first flushing period (e.g., held in configuration 390*d*). For example, the valve controller 234*a* can control the closure member 229*a* of the EHSV 220*a* in a pattern such as the example pattern shown in FIG. 7A.

In some implementations, the closure member can be configured to mix air residuals trapped in the valve assembly with hydraulic fluid provided to the valve assembly while in the second configuration. For example, the example closure member 360 includes the fluid connection 391, which provides a fluid pathway for bleeding air from the fluid control port 326 to the fluid drain port 324.

At 820, the closure member is actuated at a predetermined second velocity a predetermined second number of cycles between the first configuration, for a predetermined second drain period, and the second configuration for a predetermined second flushing period. For example, the valve controller 234*a* can control the closure member 229*a* of the EHSV 220*a* in a pattern such as the example pattern shown in FIG. 7B.

At 830, the closure member is actuated at a predetermined third velocity a predetermined third number of cycles between the first configuration, for a predetermined third drain period, and the second configuration for a predetermined third flushing period. For example, the valve controller 234*a* can control the closure member 229*a* of the EHSV 220*a* in a pattern such as the example pattern shown in FIG. 7C.

At 840, the closure member is actuated at a predetermined fourth velocity a predetermined fourth number of cycles between the first configuration, for a predetermined fourth drain period, and the second configuration for a predetermined fourth flushing period. For example, the valve controller 234*a* can control the closure member 229*a* of the EHSV 220*a* in a pattern such as the example pattern shown in FIG. 7D.

At 850, the closure member is actuated to the first configuration at predetermined fifth velocity for a predetermined fifth drain period, and to the second configuration at a predetermined fifth velocity for a predetermined fifth flushing period. For example, the valve controller 234*a* can control the closure member 229*a* of the EHSV 220*a* in a pattern such as the example pattern shown in FIG. 7E.

Figure 7A:
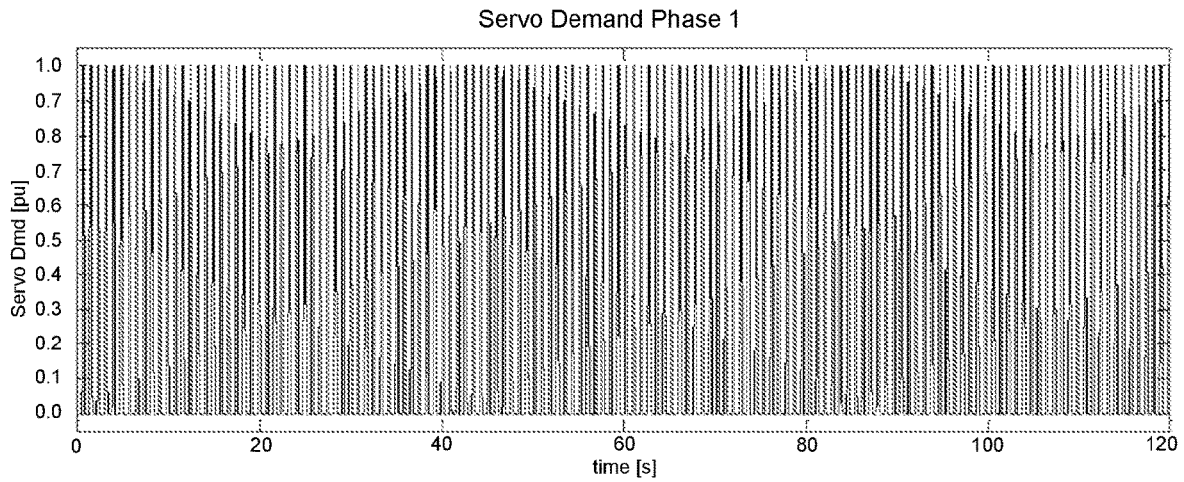
FIGS. 7A-7E are graphs of servo valve demands during an example air bleeding process.
Figure 7B:
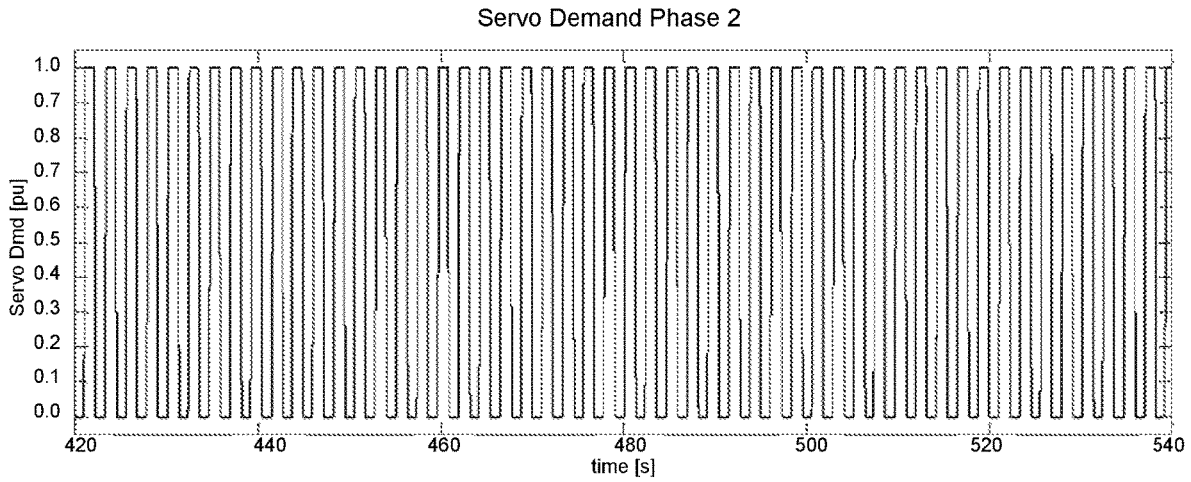
Figure 7C:
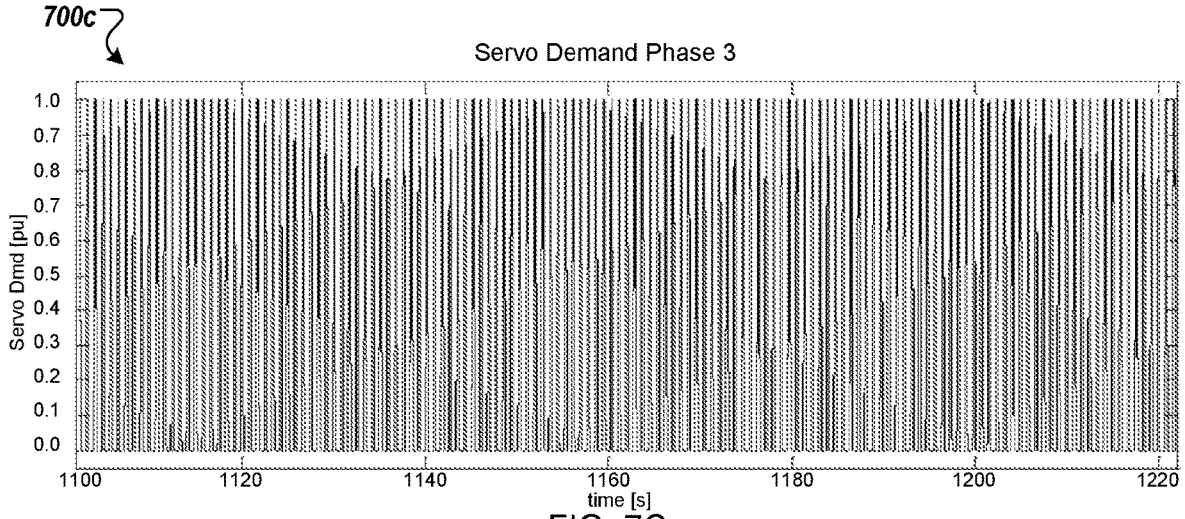
Figure 7D:
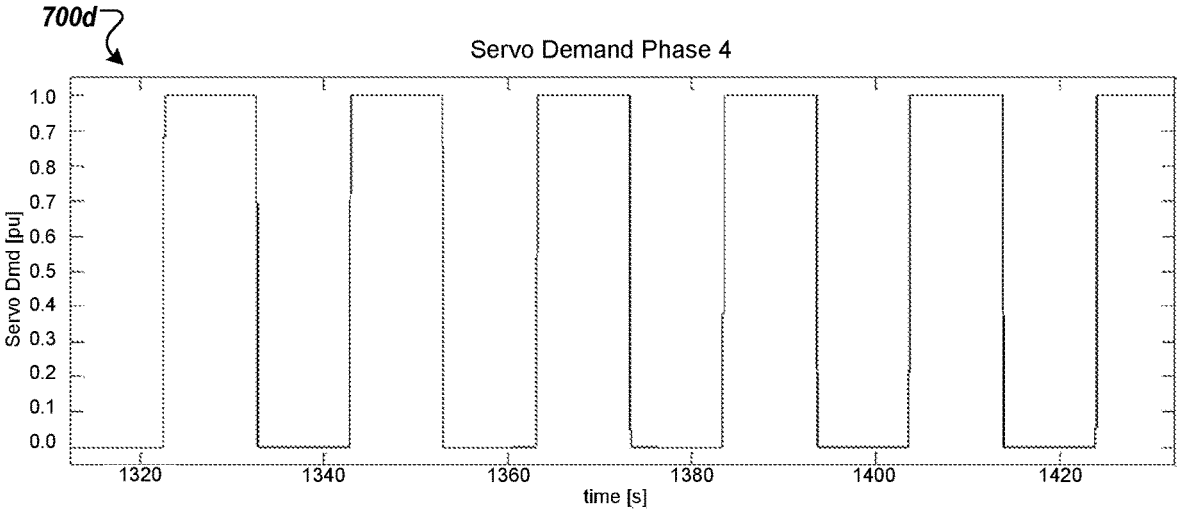

In some implementations, the second drain period can be longer than the first drain period and the third drain period, and the fourth drain period can be longer than the second drain period. For example, the drain period of the example phase 2 pattern illustrated by FIG. 7B is longer than the drain periods of phases 1 and 3 illustrated by FIGS. 7A and 7C, and the drain period of the example phase 4 pattern illustrated by FIG. 7D is longer than the drain period of phase 2 illustrated by FIG. 7B.

In some implementations, the second flushing period can be longer than the first flushing period and the third flushing period, and the fourth flushing period can be longer than the second flushing period. For example, the flushing period of the example phase 2 pattern illustrated by FIG. 7B is longer than the flushing periods of phases 1 and 3 illustrated by FIGS. 7A and 7C, and flushing period of the example phase 4 pattern illustrated by FIG. 7D is longer than the flushing period of phase 2 illustrated by FIG. 7B.

Figure 7E:
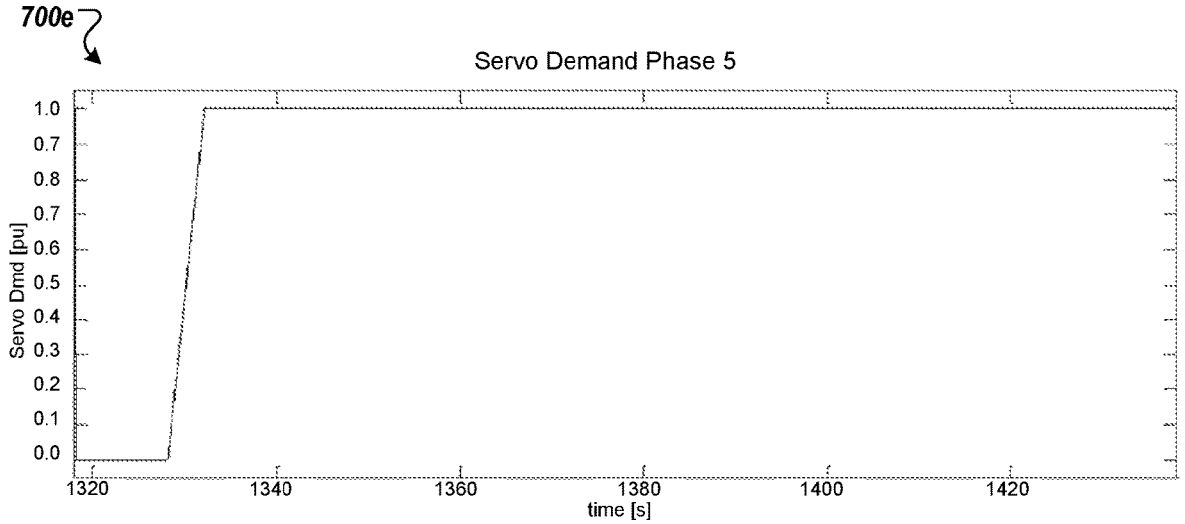

In some implementations, the fifth velocity can be less than the first velocity, the second velocity, the third velocity, and the fourth velocity. For example, the velocity of the closure member during the example phase 5 pattern illustrated by FIG. 7E is slower than the velocities used for phases 1-4.

In some implementations, one or more of the first number of cycles, the second number of cycles, the third number of cycles, the fourth number of cycles, the first drain period, the second drain period, the third drain period, the fourth drain period, the first flushing period, the second flushing period, the third flushing period, the fourth flushing period, and the fifth flushing period can be based on a pressure of hydraulic fluid provided to the valve assembly. For example, in the descriptions of FIG. 7A-7E, this document describes examples of two different configurations of five different air-bleeding phases for two different pressure ranges. Additional configurations may be used, as such configurations can be adapted for use with different application-specific pressures, flow rates, actuator fluid viscosities, nominal operating temperatures, and combinations of these and/or any other appropriate factor that can affect the amount of air that can be trapped in a system and/or the system's ability to be purged.

In some implementations, the first drain period can be less than 2 seconds, the second drain period can be less than 5 seconds, the third drain period can be less than 2 seconds, the fourth drain period can be less than 30 seconds, the fifth drain period can be less than 30 seconds, the first flushing period can be less than 1 second, the second flushing period can be less than 5 seconds, the third flushing period can be less than 1 second, the fourth flushing period can be less than 30 seconds, and the fifth flushing period can be between 10 seconds and 360 seconds. For example, the closure member 360 can be at drain for 0.5 seconds per oscillation during the example phase 1 illustrated by FIG. 7A, the closure member 360 can be at drain for 1 second per oscillation during the example phase 2 illustrated by FIG. 7B, the closure member 360 can be at drain for 0.5 seconds per oscillation during the example phase 3 illustrated by FIG. 7C, the closure member 360 can be at drain for 10 seconds per oscillation during the example phase 4 illustrated by FIG. 7D, and the closure member 360 can be at drain for 10 seconds during the example phase 5 illustrated by FIG. 7E.

In some implementations, the process can include providing a hydraulic fluid at a pressure less than or equal to 289 psig, wherein the first number of cycles is between 300 and 700, the second number of cycles is between 100 and 500, the third number of cycles is between 100 and 450, the fourth number of cycles is between 10 and 30, and the fifth number of cycles is between 1 and 5. For example, for a pressure of less than 289 psig, the example phase 1 of FIG. 7A is described as having 500 cycles, the example phase 2 of FIG. 7B is described as having 300 cycles, the example phase 3 of FIG. 7C is described as having 250 cycles, and example phase 4 of FIG. 7D is described as having 20 cycles, and the example phase 5 of FIG. 7E is described as having one cycle (e.g., between 1 and 5 cycles).

In some implementations, the process 800 can include providing a hydraulic fluid at a pressure greater than 289 psig, wherein the first number of cycles is between 100 and 500, the second number of cycles is between 50 and 300, the third number of cycles is between 50 and 300, the fourth number of cycles is between 5 and 20, and the fifth number of cycles can be between 1 and 5. For example, for a pressure greater than 289 psig, the example phase 1 of FIG. 7A is described as having 300 cycles, the example phase 2 of FIG. 7B is described as having 180 cycles, the example phase 3 of FIG. 7C is described as having 150 cycles, and the example phase 4 of FIG. 7D is described as having 12 cycles, and the example phase 5 of FIG. 7E is described as having one cycle (e.g., between 1 and 5 cycles).

In some implementations, the first velocity can be between 500% and 1000% of the closure member's travel per second, the second velocity can be between 500% and 1000% of the closure member's travel per second, the third velocity can be between 500% and 1000% of the closure member's travel per second, the fourth velocity can be between 500% and 1000% of the closure member's travel per second, and the fifth velocity can be between 10% and 50% of the closure member's travel per second. For example, the example phase 1 of FIG. 7A is described as being performed at a velocity of 750%/sec, the example phase 2 of FIG. 7B is described as being performed at a velocity of 750%/sec, the example phase 3 of FIG. 7C is described as being performed at a velocity of 750%/sec, the example phase 4 of FIG. 7D is described as being performed at a velocity of 750%/sec, and the example phase 5 of FIG. 7E is described as being performed at a velocity of 25%/sec.

In some implementations, the valve assembly can include a fluid supply port, a fluid drain port, and a fluid control port, and the valve body is configurable into a collection of valve configurations including the first configuration in which the fluid control port is in fluid communication with the fluid drain port, and the fluid supply port is blocked, the second configuration in which the fluid control port is in fluid communication with the fluid supply port and is in fluid communication with the fluid drain port through a fluid restrictor, and the fluid flow comprises flow from the fluid control port to the fluid drain port through the fluid restrictor, a third configuration in which fluid communication between the fluid control port, the fluid supply port, and the fluid drain port is blocked, and a fourth configuration in which the fluid control port is in fluid communication with the fluid supply port, and the fluid drain port is blocked. For example, the process 800 can be performed using the EHSV 300 of FIGS. 3A-3D.

Figure 9:
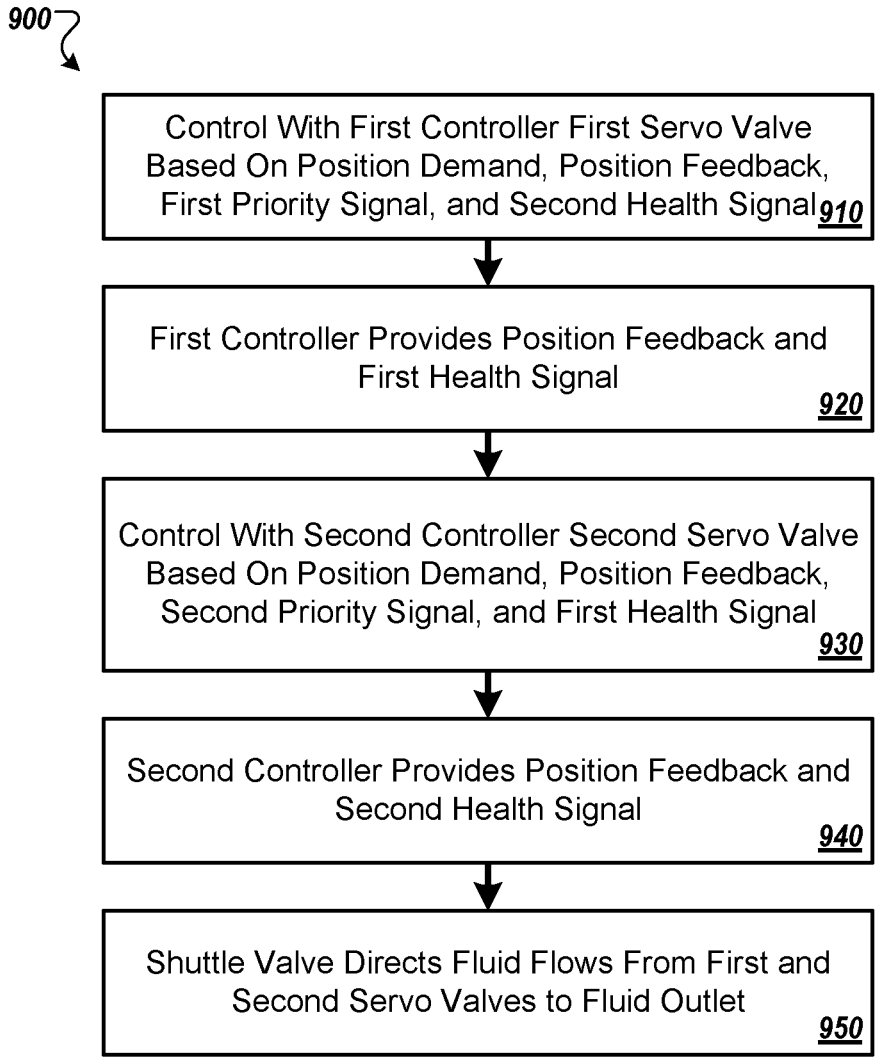
FIG. 9 is a flow diagram of an example process for communicating servo valve health status.

FIG. 9 is a flow diagram of an example process 900 for communicating servo valve health status. In some implementations, the process 900 can be performed by the example hydraulic control system 100 of FIG. 1, the example hydraulic control system 200 of FIG. 2, or the example hydraulic control system 400 of FIG. 4.

At 910 a first servo valve is controlled by a first servo controller configured to provide a first health signal to selectably permit flow between a first fluid port and a fluid source, permit flow between the first fluid port and a fluid drain, and block fluid flow between the first fluid port, the fluid source, and the fluid drain, wherein the controlling is based on a position demand signal, a position feedback signal, a first priority signal, and a second health signal. For example, the EHSV 220*a* can be controlled by the valve controller 234*a*.

At 920, the first health signal is provided by the first servo controller. For example, the valve controller 434*a* can transmit the health status signal 437*a* over the communication bus 438.

At 930 a second servo valve is controlled by a second servo controller to selectably permit flow between a second fluid port and the fluid source, permit flow between the second fluid port and the fluid drain, and block fluid flow between the second fluid port, the fluid source, and the fluid drain, wherein the controlling is based on the position demand signal, the position feedback signal, a second priority signal, and the first health signal. For example, the EHSV 220*b* can be controlled by the valve controller 234*b*.

At 940, the second servo controller provides the second health signal. For example, the valve controller 434*b* can transmit the health status signal 437*b* over the communication bus 438.

At 950, a shuttle valve directs fluid flow between a selectable one of the first fluid port and the second fluid port, and a fluid outlet configured to be fluidically connected to a fluid actuator. For example, the shuttle valve 240 can switch between connecting the main fluid control conduit 205 to the fluid control port 226*a* and connecting main fluid control conduit 205 to the fluid control port 226*b*.

In some implementations, at least one of the first priority signal and the second priority signal can include representations of one or more operational conditions including (a) a high priority command provided to a selected one of the first servo controller or the second servo controller to act as a primary servo controller, and (b) a low priority command provided to the other of the first servo controller or the second servo controller to act as a reserve servo controller. For example, the controller 230 can send a command to the valve controller 234*a* to operate as the primary controller for the fluid actuator 203, and the controller 230 can send a command to the valve controller 234*b* to operate as a secondary (e.g., backup or standby) controller for the fluid actuator 203.

In some implementations, the process 900 can also include receiving, by the first servo controller, the high priority command as the first priority signal, controlling, by the first servo controller, the first servo valve to control a position of the fluid actuator by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. For example, when the valve controller 234*a* is commanded to act as the primary controller, the valve controller 234*a* can take control over the fluid actuator 203 by controlling the EHSV 220*a*.

In some implementations, at least one of the first health signal and the second health signal include representations of one or more operational conditions including an operable condition indicating an absence of failure, a fail condition indicative of a failure that is addressable by a shutdown of a corresponding one of the first servo valve or the second servo valve, and a failure of the health signal that represents an inability to transmit any of above conditions. For example, the health status receiver 418*b* can receive the health status signal 437*a* and determine if the valve controller 434*a* is in a normal operational state or if it has detected a malfunction and needs to be shut down.

In some implementations, the process 900 can also include controlling, by the first servo controller, the first servo valve to control a position of the fluid actuator by modulating fluid connectivity from the fluid source to the fluid actuator and from the fluid actuator to the fluid drain, and controlling, by the second servo controller, the second servo valve to provide a restricted fluidic connection from the second fluid port to the fluid drain when the position demand signal indicates a nonzero demanded position, and to provide an unrestricted fluidic connection from the second fluid port to the fluid drain when the position demand signal indicates a zero-proximal demanded position. For example, when the EHSV 220*b* is acting as the primary EHSV to control the fluid actuator 203, the EHSV 220*a* can be 229*b* close to the null position (e.g., configuration 390*b*) in case fast action is needed to take over control.

In some implementations, the process 900 can also include receiving, by the first servo controller, the low priority command as the first priority signal detecting, by the first servo controller, the fail condition in the second servo controller or the second servo valve, controlling, by the first servo controller, the first servo valve to control a position of the fluid actuator by (a) modulating fluid connectivity from the fluid source to the first fluid port, (b) modulating fluid connectivity from the first fluid port to the fluid drain, and (c) blocking fluid flow between the first fluid port, the fluid source, and the fluid drain. For example, when the valve controller 234*a* is commanded to act as the secondary controller but detects that the servo controller 234*b* has a fault, the valve controller 234*a* can immediately take control over the fluid actuator 203 by adequate control of EHSV 220*a*.

In some implementations, the process 900 can also include controlling, by the first servo controller, the first servo valve to control a position of the fluid actuator by modulating fluid connectivity from the fluid source to the fluid actuator and from the fluid actuator to the fluid drain, detecting, by the first servo controller, a fault condition in the first servo controller or the first servo valve, transmitting a fault signal indicative of the detected fault condition as the first health signal, and controlling, by the second servo controller and in response to the fault signal, the second servo valve to selectably permit flow between the second fluid port and the fluid source, permit flow between the second fluid port and the fluid drain, and block fluid flow between the second fluid port, the fluid source, and the fluid drain. For example, the valve controller 234*a* can identify a fault within itself while functioning as the primary controller for the fluid actuator 203, and respond by modifying its health signal to indicate the fault (e.g., a slow fail signal or a fast fail signal). The valve controller 234*b* can receive and interpret the health signal, and respond by taking over control of the fluid actuator 203 from the valve controller 234*a*.

In some implementations, the process 900 can also include receiving, by the first servo controller, the low priority command as the first priority signal, detecting, by the first servo controller, the operable condition in the second servo controller and the second servo valve, and controlling, by the first servo controller, the first servo valve to provide a fluidic connection from the first fluid port to the fluid drain and to block the fluid source. For example, the controller 230 can command the valve controller 234*a* to operate as the secondary, backup controller, and if it also detects that the valve controller 234*b* is indicating that it is fully operational, the valve controller 234*a* can transition into standby mode by controlling the EHSV 220*a* to the configuration 390*a*.

In some implementations, the process 900 can also include controlling, by the first servo controller, the first servo valve to control a position of the fluid actuator by modulating fluid connectivity from the fluid source to the fluid actuator and from the fluid actuator to the fluid drain, detecting, by the second servo controller, a fault condition in the second servo controller or the second servo valve, transmitting a fault signal indicative of the detected fault condition as the second health signal, receiving, by the first servo controller, a command signal configured to transfer control of the fluid actuator from the first servo controller and the first servo valve to the second servo controller and the second servo valve, and ignoring, by the by the first servo controller and based on the fault signal, the command signal. For example, when the valve controller 234*a* is acting as the primary controller for the fluid actuator 203 and a fault signal is received from the valve controller 234*b*, the valve controller 234*a* may ignore a command from the controller 230 to transfer control to the valve controller 234*b* (e.g., to prevent switchover to a faulty EHSV module).

In some implementations, the process 900 can also include receiving, by the first servo controller, the low priority command as the first priority signal, detecting, by the first servo controller, the failure of the second health signal, determining, by the first servo controller and based on the detecting, a modified position demand that is less than a position demand represented by the position demand signal, controlling, by the first servo controller, the first servo valve to control a position of the fluid actuator based on the modified position demand by (a) modulating fluid connectivity from the fluid source to the first fluid port, (b) modulating connectivity from the first fluid port to the fluid drain, and (c) blocking fluid flow between the first fluid port, the fluid source, and the fluid drain. For example, when the valve controller 234*b* detects a failure of the health signal from the valve controller 234*a* (e.g., as opposed to a fault in the valve controller 234*a* itself), the exact status of the valve controller 234*a* can be unknown (e.g., cannot differentiate between a malfunction of the valve controller or a malfunction in the communications downstream from the valve controller). In circumstances such as this, the valve controller 234*b* can switch into a parallel primary controller mode, where the EHSV 220*b* is controlled based on a modification of the demanded position to place the EHSV 220*b* in a state of operation that closely follows the output that the EHSV 220*a* may or may not still be providing. In some examples, this type of operation can create a safe fallback position without causing the shuttle valve 240 to switch over from the EHSV 220*a* if it is still operating normally.

In some implementations, the process 900 can also include detecting, by the second servo controller, a failure of the first health signal, determining, by the second servo controller and based on the detecting, a modified position demand that is less than a position demand represented by the position demand signal, and controlling, by the second servo controller and based on the modified position demand, the second servo valve. For example, the valve controller 234*b* can detect a short to ground, a short to battery, or an undefined (e.g., noise) state on the health signal from the valve controller 234*a*. Persons of skill in the art utilize a number of existing communication techniques that can be used to convey operational status and/or control messages while also determining an operational status of the communication link itself. For example, 4 mA to 20 mA current loops are used, in which information is communicated on a digital signal that uses 20 mA as a high or "1" signal and uses 4 mA as a low or "0" signal, while currents closer to zero can represent a shorted or open communication circuit. In another example, digital communications can include checksums, in which communicated information (e.g., commands, statuses) is accompanied by mathematically hashed information that can be compared to received communications to determine if the information was received correctly or if the information had been corrupted by noise. Since these states may indicate a communication rather than a control fault (e.g., the valve controller 234*a* and the EHSV 220*a* may still be operating normally), the valve controller 234*b* may respond by controlling the EHSV 220*b* in a manner that causes it to provide slightly less than the pressure that is commanded by the controller 230. As such, the provided pressure is nearly the same as the pressure that may or may not be getting provided by the EHSV 220*a* (e.g., to act as a close fallback for the commanded pressure level) but will not cause switchover of the shuttle valve 240 if the EHSV 220*a* is still operating normally.

In some implementations, the process 900 can include receiving, by the first servo controller, a command signal configured to transfer control of the fluid actuator from the first servo controller and the first servo valve to the second servo controller and the second servo valve, receiving, by the second servo controller, a command signal configured to transfer control of the fluid actuator from the first servo controller and the first servo valve to the second servo controller and the second servo valve, controlling, by the second servo controller and in response to the received command signal, the second servo valve to selectably permit flow between the second fluid port and the fluid source, permit flow between the second fluid port and the fluid drain, and block fluid flow between the second fluid port, the fluid source, and the fluid drain, and controlling, by the first servo controller and based on the received command signal, the first servo valve to at least permit fluid flow between the first fluid port and drain, and block the fluid supply. For example, if the valve controller 234*a* is in control of the process and the controller 230 requests a switchover of control, the valve controller 234*b* can respond by controlling the EHSV 220*b* to control the fluid actuator 203, and the valve controller 234*a* can control the EHSV 220*a* to provide an output pressure that is slightly below the commanded pressure.

In some implementations, the process 900 can also include receiving, by the first servo controller, the low priority command as the first priority signal, controlling, by the first servo controller and based on the receiving, the first servo valve to a standby position based on a standby demand, detecting, by the first servo controller and based on the second health signal, the operable condition in the second servo controller and the second servo valve, receiving, by the first servo controller, a command signal representative of a silt reduction operation, controlling, by the first servo controller and in response to the received command signal, the first servo valve to a first modified position that is below standby position, and controlling, by the first servo controller and in response to the received command signal, the first servo valve to the standby position. For example, the controller 230 can request the valve controller 234*a* to switch over to standby (e.g., secondary, backup) mode, and if the valve controller 234*a* determines that it is safe to do so (e.g., receiving a healthy operation signal from the valve controller 234*b*), then the valve controller 234*a* can switch over to standby operation. The controller 230 can request the valve controller 234*a* to perform an operation that prevents or reduces build-up (e.g., dirt, silt) that may have accumulated in the EHSV 220*a*. In response, the valve controller 234*a* can causes the closure member 229*a* to oscillate slightly in a manner in which the closure member changes its position by the distance that accumulated dirt releases from the closure member and valve surfaces (e.g., to agitate and loosen internal buildup of contamination). The movement is directed only into the drain direction to avoid potential disturbances on the fluid actuator.

In some implementations, the process 900 can also include receiving, by the first servo controller, a command signal representative of a silt reduction operation, receiving, by the second servo controller, the command signal, wherein the second servo controller is operating at a standby demand, controlling, by the first servo controller and in response to the received command signal, the first servo valve to a first modified position that is below a position demand represented by the position demand signal, controlling, by the first servo controller and in response to the received command signal, the first servo valve to a second modified position that is above the position demand, controlling, by the first servo controller and in response to the received command signal, the first servo valve based on the position demand, controlling, by the second servo controller and in response to the received command signal, the second servo valve to a third modified position that is below the standby demand, and controlling, by the second servo controller and in response to the received command signal, the second servo valve based on the standby demand. For example, the controller 230 can request the valve controller 234*a* to perform an operation that prevents or reduces build-up (e.g., dirt, silt) that may have accumulated in the EHSV 220*a*. In response, the valve controller 234*b* can operate the EHSV 220*b* slightly below the demanded pressure (e.g., to act as a backup in case the EHSV 220*a* malfunctions during the cleaning process). The valve controller 234*a* remains in control of the fluid actuator 203, and causes the closure member 229*a* to oscillate slightly in a manner that causes the output pressure to repeatedly vary slightly above and slightly below the demanded pressure (e.g., to agitate and loosen internal buildup of contamination).

In some implementations, the process 900 can also include moving a selected one of the first servo valve and the second servo valve between a first position to permit flow between drain and corresponding one of the first fluid port and the second fluid port, and moving a selectable one of the selected servo valve to a second position configured to provide an air bleeding fluid path between the fluid drain and the fluid source and the corresponding one of the first fluid port and the second fluid port. For example, one or both of the EHSVs 220*a* and 220*b* can be controlled to have the example configuration 390*d* of FIG. 3D. In another example, one or both of the EHSVs 220*a* and 220*b* can be controlled to perform the example air bleeding operations discussed in the descriptions of FIGS. 7A-8.

Figure 10:
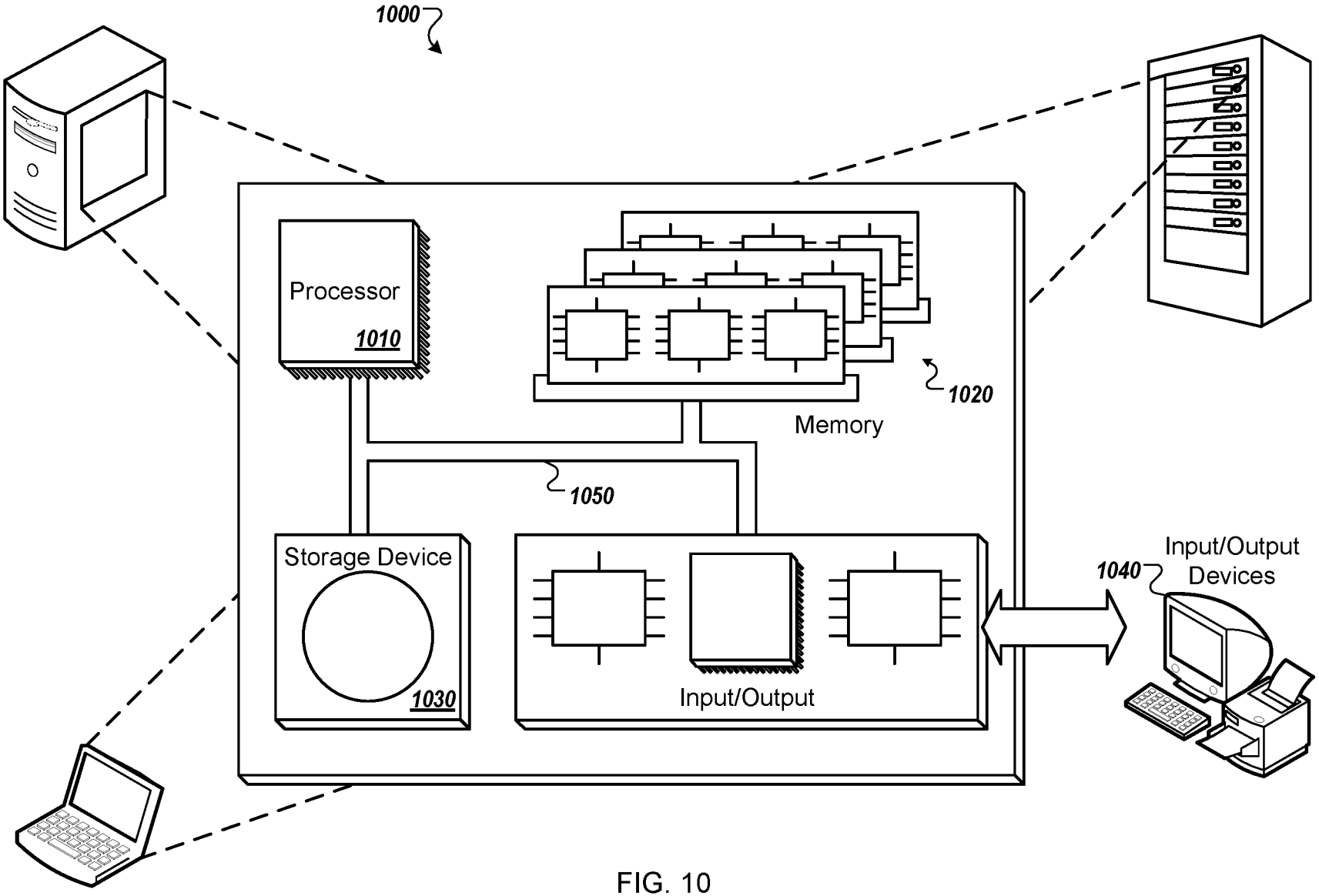
FIG. 10 is a schematic diagram of an example of a generic computer system.

FIG. 10 is a schematic diagram of an example of a generic computer system 1000. The system 1000 can be used for the operations described in association with any or all of the example controller 230, the example EHSV module 120*a*, the example EHSV module 120*b*, the example controller 230, the example controller 230, the example valve controller 234*a*, the example controller 324*b*, the example valve controller 434*a*, or the example controller 434*b*.

The system 1000 includes a processor 1010, a memory 1020, a storage device 1030, and an input/output device 1040. Each of the components 1010, 1020, 1030, and 1040 are interconnected using a system bus 1050. The processor 1010 is capable of processing instructions for execution within the system 1000. In one implementation, the processor 1010 is a single-threaded processor. In another implementation, the processor 1010 is a multi-threaded processor. The processor 1010 is capable of processing instructions stored in the memory 1020 or on the storage device 1030 to display graphical information for a user interface on the input/output device 1040.

The memory 1020 stores information within the system 1000. In one implementation, the memory 1020 is a computer-readable medium. In one implementation, the memory 1020 is a volatile memory unit. In another implementation, the memory 1020 is a non-volatile memory unit.

The storage device 1030 is capable of providing mass storage for the system 1000. In one implementation, the storage device 1030 is a computer-readable medium. In various different implementations, the storage device 1030 may be a floppy disk device, a hard disk device, an optical disk device, or a tape device.

The input/output device 1040 provides input/output operations for the system 1000. In one implementation, the input/output device 1040 includes a keyboard and/or pointing device. In another implementation, the input/output device 1040 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, e.g., in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

Although a few implementations have been described in detail above, other modifications are possible. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method of operating a hydraulic actuator system, the method comprising:

actuating a closure member of a valve assembly at a predetermined first velocity a predetermined first number of cycles between a first configuration in which fluid flow is drained for a predetermined first drain period and a second configuration in which a fluid flow path is flushed for a predetermined first flushing period;

actuating the closure member at a predetermined second velocity a predetermined second number of cycles between the first configuration for a predetermined second drain period and the second configuration for a predetermined second flushing period;

actuating the closure member at a predetermined third velocity a predetermined third number of cycles between the first configuration for a predetermined third drain period and the second configuration for a predetermined third flushing period;

actuating the closure member at a predetermined fourth velocity a predetermined fourth number of cycles between the first configuration for a predetermined fourth drain period and the second configuration for a predetermined fourth flushing period; and actuating the closure member at a predetermined fifth velocity a predetermined fifth number of cycles between the first configuration for a predetermined fifth drain period and the second configuration for a predetermined fifth flushing period.

2. The method of claim 1, wherein the closure member is configured to flush air residuals trapped in the valve assembly with hydraulic fluid provided to the valve assembly while in the second configuration.

3. The method of claim 1, wherein the second drain period is longer than the first drain period and the third drain period, and the fourth drain period is longer than the second drain period.

4. The method of claim 1, wherein the second flushing period is longer than the first flushing period and the third flushing period, the fourth flushing period is longer than the second flushing period, and the fifth flushing period is longer than fourth flushing period.

5. The method of claim 1, wherein the fifth velocity is less than the first velocity, the second velocity, the third velocity, and the fourth velocity.

6. The method of claim 1, wherein one or more of the first number of cycles, the second number of cycles, the third number of cycles, the fourth number of cycles, the first drain period, the second drain period, the third drain period, the fourth drain period, the fifth drain period, the first flushing period, the second flushing period, the third flushing period, the fourth flushing period, and the fifth flushing period are based on a pressure of hydraulic fluid provided to the valve assembly.

7. The method of claim 1, wherein the first drain period is less than 2 seconds, the second drain period is less than 5 seconds, the third drain period is less than 2 seconds, the fourth drain period is less than 30 seconds, the fifth drain period is less than 30 seconds, the first flushing period is less than 1 second, the second flushing period is less than 5 seconds, the third flushing period is less than 1 second, the fourth flushing period is less than 30 seconds, and the fifth flushing period is between 10 seconds and 360 seconds.

8. The method of claim 1, further comprising providing a hydraulic fluid at a pressure less than or equal to 289 psig, wherein the first number of cycles is between 300 and 700, the second number of cycles is between 100 and 500, the third number of cycles is between 100 and 450, the fourth number of cycles is between 10 and 30, and the fifth number of cycles is between 1 and 10.

9. The method of claim 1, further comprising providing a hydraulic fluid at a pressure greater than 289 psig, wherein the first number of cycles is between 100 and 500, the second number of cycles is between 50 and 300, the third number of cycles is between 50 and 300, the fourth number of cycles is between 5 and 20, and the fifth number of cycles is between 1 and 10.

10. The method of claim 1, wherein the first velocity is between 500%/sec and 1000%/sec of a travel of the closure member, the second velocity is between 500%/sec and 1000%/sec of the closure member's travel, the third velocity is between 500%/sec and 1000%/sec of the closure member's travel, the fourth velocity is between 500%/sec and 1000%/sec of the closure member's travel, and the fifth velocity is between 10%/sec and 50%/sec of the closure member's travel.

11. The method of claim 1, wherein the valve assembly comprises:

a fluid supply port, a fluid drain port, and a fluid control port; and the closure member is configurable into a plurality of valve configurations comprising:

the first configuration in which the fluid control port is in fluid communication with the fluid drain port, and the fluid supply port is blocked;

the second configuration in which the fluid control port is in fluid communication with the fluid supply port and is in fluid communication with the fluid drain port through a fluid restrictor, and the fluid flow comprises flow from the fluid control port to the fluid drain port through the fluid restrictor;

a third configuration in which fluid communication between the fluid control port, the fluid supply port, and the fluid drain port is blocked; and a fourth configuration in which the fluid control port is in fluid communication with the fluid supply port, and the fluid drain port is blocked.

12. A hydraulic actuator system comprising:

a valve assembly having a fluid supply port in fluid communication with the main fluid supply conduit, a fluid drain port, and a fluid control port in fluid communication with the main fluid control conduit; and a controller configured to control operation of the valve assembly, the operations comprising:

actuating a closure member of the valve assembly at a predetermined first velocity a predetermined first number of cycles between a first configuration in which fluid flow is drained for a predetermined first drain period and a second configuration in which a fluid flow path is flushed for a predetermined first flushing period;

actuating the closure member at a predetermined second velocity a predetermined second number of cycles between the first configuration for a predetermined second drain period and the second configuration for a predetermined second flushing period;

actuating the closure member at a predetermined third velocity a predetermined third number of cycles between the first configuration for a predetermined third drain period and the second configuration for a predetermined third flushing period;

actuating the closure member at a predetermined fourth velocity a predetermined fourth number of cycles between the first configuration for a predetermined fourth drain period and the second configuration for a predetermined fourth flushing period; and actuating the closure member at a predetermined fifth velocity a predetermined fifth number of cycles between the first configuration for a predetermined fifth drain period and the second configuration for a predetermined fifth flushing period.

13. The hydraulic actuator system of claim 12, wherein actuation of the closure member flushes air residuals trapped in the valve assembly with hydraulic fluid provided to the valve assembly.

14. The hydraulic actuator system of claim 12, wherein the second drain period is longer than the first drain period and the third drain period, and the fourth drain period is longer than the second drain period.

15. The hydraulic actuator system of claim 12, wherein the second flushing period is longer than the first flushing period and the third flushing period, the fourth flushing period is longer than the second flushing period, and the fifth flushing period is longer than fourth flushing period.

16. The hydraulic actuator system of claim 12, wherein the fifth velocity is less than the first velocity, the second velocity, the third velocity, and the fourth velocity.

17. The hydraulic actuator system of claim 12, wherein one or more of the first number of cycles, the second number of cycles, the third number of cycles, the fourth number of cycles, the first drain period, the second drain period, the third drain period, the fourth drain period, the fifth drain period, the first flushing period, the second flushing period, the third flushing period, the fourth flushing period, and the fifth flushing period are based on a pressure of hydraulic fluid provided to the valve assembly.

18. The hydraulic actuator system of claim 12, wherein the first drain period is less than 2 seconds, the second drain period is less than 5 seconds, the third drain period is less than 2 seconds, the fourth drain period is less than 30 seconds, the fifth drain period is less than 30 seconds, the first flushing period is less than 1 second, the second flushing period is less than 5 seconds, the third flushing period is less than 1 second, the fourth flushing period is less than 30 seconds, and the fifth flushing period is between 10 seconds and 360 seconds.

19. The hydraulic actuator system of claim 12, the operations further comprising providing a hydraulic fluid at a pressure less than or equal to 289 psig, wherein the first number of cycles is between 300 and 700, the second number of cycles is between 100 and 500, the third number of cycles is between 100 and 450, the fourth number of cycles is between 10 and 30, and the fifth number of cycles is between 1 and 10.

20. The hydraulic actuator system of claim 12, the operations further comprising providing a hydraulic fluid at a pressure greater than 289 psig, wherein the first number of cycles is between 100 and 500, the second number of cycles is between 50 and 300, the third number of cycles is between 50 and 300, the fourth number of cycles is between 5 and 20, and the fifth number of cycles is between 1 and 10.

21. The hydraulic actuator system of claim 12, wherein the first velocity is between 500%/sec and 1000%/sec of a travel of the closure member, the second velocity is between 500%/sec and 1000%/sec of the closure member's travel, the third velocity is between 500%/sec and 1000%/sec of the closure member's travel, the fourth velocity is between 500%/sec and 1000%/sec of the closure member's travel, and the fifth velocity is between 10%/sec and 50%/sec of the closure member's travel.

22. The hydraulic actuator system of claim 12, wherein the valve assembly comprises:

a fluid supply port, a fluid drain port, and a fluid control port; and the closure member is configurable into a plurality of valve configurations comprising:

the first configuration in which the fluid control port is in fluid communication with the fluid drain port, and the fluid supply port is blocked;

the second configuration in which the fluid control port is in fluid communication with the fluid supply port and is in fluid communication with the fluid drain port through a fluid restrictor, and the fluid flow comprises flow from the fluid control port to the fluid drain port through the fluid restrictor;

a third configuration in which fluid communication between the fluid control port, the fluid supply port, and the fluid drain port is blocked; and a fourth configuration in which the fluid control port is in fluid communication with the fluid supply port, and the fluid drain port is blocked.

* * * * *